US011453995B2

(12) United States Patent
Ito et al.

(10) Patent No.: US 11,453,995 B2
(45) Date of Patent: Sep. 27, 2022

(54) WORK MACHINE

(71) Applicant: HITACHI CONSTRUCTION MACHINERY CO., LTD., Tokyo (JP)

(72) Inventors: Masamichi Ito, Ushiku (JP); Ryuu Narikawa, Mito (JP); Shinya Imura, Toride (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 394 days.

(21) Appl. No.: 16/641,772

(22) PCT Filed: Apr. 17, 2018

(86) PCT No.: PCT/JP2018/015917

§ 371 (c)(1),
(2) Date: Feb. 25, 2020

(87) PCT Pub. No.: WO2019/202673

PCT Pub. Date: Oct. 24, 2019

(65) Prior Publication Data

US 2020/0248430 A1 Aug. 6, 2020

(51) Int. Cl.
*E02F 9/22* (2006.01)
*E02F 3/43* (2006.01)
(Continued)

(52) U.S. Cl.
CPC ..... *E02F 3/435* (2013.01); *E02F 9/2203* (2013.01); *E02F 3/32* (2013.01); *E02F 9/2004* (2013.01)

(58) Field of Classification Search
CPC . E02F 3/435; E02F 3/32; E02F 9/2285; E02F 9/268; E02F 9/2203
See application file for complete search history.

(56) References Cited

U.S. PATENT DOCUMENTS 5,768,810 A * 6/1998 Ahn ..... E02F 3/436 701/50
10,801,187 B2 * 10/2020 Izumi ..... E02F 3/435
(Continued)

FOREIGN PATENT DOCUMENTS

JP 2016-75358 A 5/2016
WO 2013/094616 A1 6/2013
(Continued)

OTHER PUBLICATIONS

International Preliminary Report on Patentability received in corresponding International Application No. PCT/JP2018/015917 dated Oct. 29, 2020.
(Continued)

*Primary Examiner* — Abiy Teka
(74) *Attorney, Agent, or Firm* — Mattingly & Malur, PC

(57) ABSTRACT

A hydraulic excavator (1) is provided with a controller (40) including an actuator control section (81) which, when an operation device (45, 46) is operated, controls at least one of a plurality of hydraulic actuators (5, 6, 7) in accordance with the velocities of the plurality of hydraulic actuators (5, 6, 7) and a predetermined condition. The controller (40) determines, based on a sensed value from a posture sensor (50), the direction of a load exerted on an arm cylinder (6) due to the weight of an arm (9), outputs, upon determining that the direction of the load is opposite to a driving direction of the arm cylinder (6), a second velocity Vamt2 to the actuator control section (81), and outputs, upon determining that the direction of the load is the same as the driving direction of the arm cylinder (6), a third velocity Vamt3 to the actuator control section (81).

4 Claims, 15 Drawing Sheets

(51) Int. Cl.
*E02F 3/32* (2006.01)
*E02F 9/20* (2006.01)

(56) References Cited

U.S. PATENT DOCUMENTS

| | | | | |
|---|---|---|---|---|
| 2014/0121840 | A1* | 5/2014 | Mizuochi | G06F 30/15 700/275 |
| 2014/0371995 | A1 | 12/2014 | Udagawa et al. | |
| 2016/0069044 | A1 | 3/2016 | Takaura et al. | |
| 2016/0265187 | A1 | 9/2016 | Baba et al. | |
| 2016/0281331 | A1 | 9/2016 | Ikegami et al. | |
| 2017/0275852 | A1 | 9/2017 | Yamashita et al. | |
| 2020/0157768 | A1* | 5/2020 | Ito | E02F 9/2271 |

FOREIGN PATENT DOCUMENTS

| | | | |
|---|---|---|---|
| WO | 2015/025985 | A1 | 2/2015 |
| WO | 2015/129930 | A1 | 9/2015 |
| WO | 2015/137524 | A1 | 9/2015 |

OTHER PUBLICATIONS

Korean Office Action received in corresponding Korean Application No. 10-2020-7004664 dated Aug. 31, 2021.
International Search Report of PCT/JP2018/015917 dated Jun. 5, 2018.

* cited by examiner

WORK MACHINE

TECHNICAL FIELD

The present invention relates to a work machine that controls at least one of a plurality of hydraulic actuators according to a predetermined condition when an operation device is operated.

BACKGROUND ART

As a technology for enhancing the work efficiency of a work machine (for example, hydraulic excavator) having a work device (for example, front work device) driven by hydraulic actuators, there is machine control (MC). The MC is a technology by which a semi-automatic control for operating a work device according to a predetermined condition is performed to support an operator's operation, in the case where an operation device is operated by the operator.

For example, Patent Document 1 discloses a technology for controlling a front work device such as to move the claw tip of a bucket along a target design landform (target surface). This document mentions as a problem that in the case where the operation amount of an arm operation lever is small, an actual arm cylinder velocity may become higher than an estimated arm cylinder velocity calculated based on the operation amount of the arm operation lever, due to the fall of the bucket due to its own weight, depending on the posture of the front work device, and, performing MC based on the estimated arm cylinder velocity in such a situation may result in that the blade tip of the bucket becomes instable and hunting is generated. In addition, according to this document, in the case where the operation amount of the arm operation lever is less than a predetermined amount, a velocity higher than the velocity calculated based on the operation amount of the arm operation lever is calculated as an estimated arm cylinder velocity taking into account the fall of the bucket due to its own weight, and MC is performed based on the estimated velocity, in order to solve the above-mentioned problem.

PRIOR ART DOCUMENT

Patent Document

Patent Document 1: WO2015/025985

SUMMARY OF THE INVENTION

Problem to be Solved by the Invention

When the fall of the bucket due to its own weight is taken into account at the time of calculating the estimated arm cylinder velocity like in the technology of Patent Document 1, the estimated velocity approaches the actual velocity of the arm cylinder, and, therefore, generation of hunting during MC can be prevented. However, the deviation between the estimated velocity and the actual velocity of the arm cylinder based on the operation amount of the arm operation lever is not due only to the fall of the bucket by its own weight. Therefore, only the estimation of the arm cylinder velocity by taking into account the fall of the bucket due to its own weight like Patent Document 1 is insufficient for preventing the generation of hunting.

For example, in the case of raking and smoothing earth and sand, or so-called cutting-up work, for an inclined surface located on the lower side of the track structure of a work machine as depicted in FIG. 15, the arm cylinder is driven mainly in a direction for lifting up the front work device against the weight of the arm and the bucket. In other words, in the cutting-up work, the arm cylinder velocity is rarely accelerated as compared to the estimation due to the influence of the weight of the front work device (arm or bucket) on the driving of the arm cylinder. Rather, due to the influence of driving the front work device in the direction of lifting up against the weight, the arm cylinder velocity may be slowed as compared to the estimated velocity.

The phenomenon in which the arm cylinder velocity is thus decelerated as compared to the estimated velocity due to the weight of the front work device becomes more conspicuous in hydraulic systems of the open center bypass system (also called open center system). FIG. 16 depicts opening area characteristics of a spool of the open center bypass system. The opening area of the spool of the open center bypass system includes a center bypass opening of a line through which hydraulic fluid from a pump flows to a tank, a meter-in opening of a line through which the hydraulic fluid is supplied from the pump to an actuator, and a meter-out opening of a line through which the hydraulic fluid flows from the actuator to the tank. A closing-up point at which the area of the center bypass opening becomes zero is SX.

Here, the flow of the hydraulic fluid in the case of driving the arm cylinder in the direction of lifting up the front work device against the its own weight like in the cutting-up work will be described. In this case, since the arm cylinder is driven in the direction for lifting up the front work device against its own weight, the pressure on the meter-in side is raised by the weight of the front work device. In the case where the operation amount of the arm operation lever is small and the stroke amount of the spool is less than SX, the hydraulic fluid supplied from the pump is divided into a portion supplied to the arm cylinder through the meter-in opening (meter-in line) and a portion flowing to the tank through the center bypass opening (center bypass line), since the center bypass opening is open. Since the hydraulic fluid is liable to flow in a direction in which load is lighter, the hydraulic fluid is less liable to flow to the arm cylinder as compared to the case where the arm cylinder is not driven in the direction of lifting up the front work device against its own weight; as a result, the arm cylinder velocity is decelerated.

In this way, depending on the contents of work for the work device, the arm cylinder velocity may become slower than the estimated velocity, resulting in that the blade tip of the bucket (the tip of the work device) may become instable and hunting may occur, at the time of performing a semi-automatic control.

It is an object of the present invention to provide a work machine which can calculate more appropriately the velocity of an arm cylinder for driving a work device and in which the behavior of the tip of the work device (for example, the bucket blade tip) in MC is stabilized.

Means for Solving the Problem

The present application includes a plurality of means for solving the above-mentioned problem, one example of the plurality of means being a work machine including: a work device that has a plurality of front members including an arm; a plurality of hydraulic actuators that include an arm cylinder driving the arm and that drive the plurality of front members; an operation device that gives instruction on operations of the plurality of hydraulic actuators according to an operation of an operator; a controller having an actuator control section that controls at least one of the plurality of hydraulic actuators according to velocities of the plurality of hydraulic actuators and a predetermined condition when the operation device is operated; a posture sensor that senses a physical quantity concerning a posture of the arm; and an operation amount sensor that senses a physical quantity concerning an operation amount for the arm of operation amounts of the operation device. In the work machine, the controller includes: a first velocity calculation section that calculates a first velocity calculated from a sensed value from the operation amount sensor as a velocity of the arm cylinder; a second velocity calculation section that, based on a sensed value from the posture sensor, determines a direction of a load applied to the arm cylinder by the weight of the arm, and, upon determining that the direction of the load is opposite to a driving direction of the arm cylinder, calculates as the velocity of the arm cylinder a second velocity lower than the first velocity as a velocity of the arm cylinder; and a third velocity calculation section that, upon determining that the direction of the load is the same as the driving direction of the arm cylinder, calculates as the velocity of the arm cylinder a third velocity equal to or higher than the first velocity as a velocity of the arm cylinder.

Advantages of the Invention

According to the present invention, the velocity of the arm cylinder for driving the work device can be calculated more suitably, and the behavior of the tip of the work device in MC can be stabilized.

MODES FOR CARRYING OUT THE INVENTION

Figure 1:
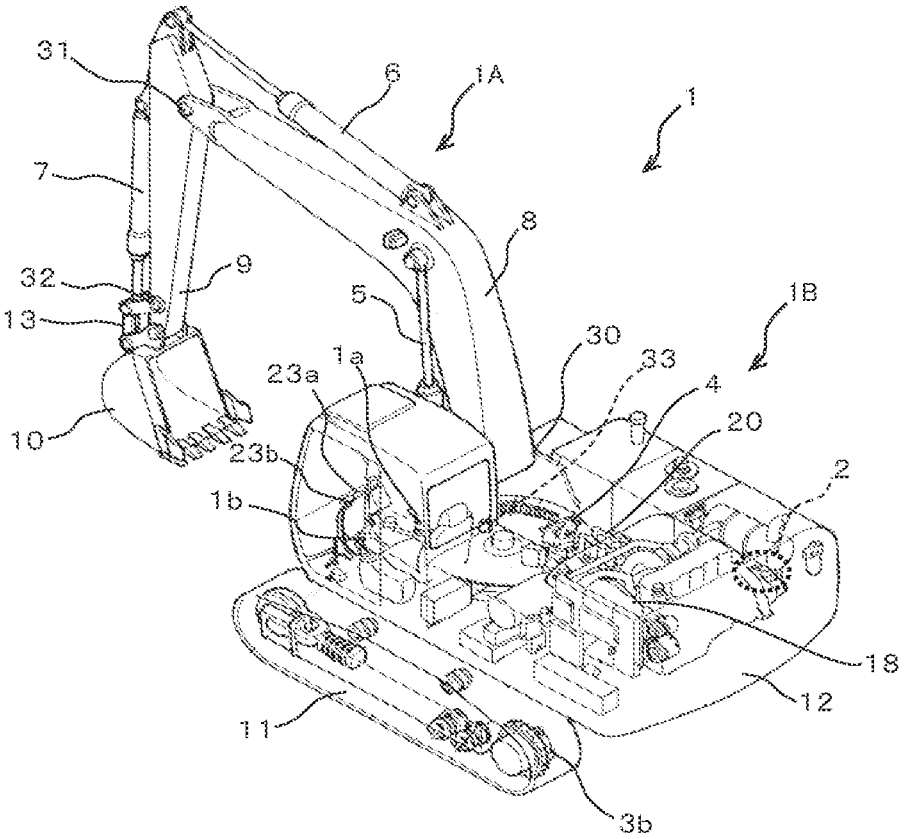
FIG. 1 is a configuration diagram of a hydraulic excavator.

An embodiment of the present invention will be described below referring to the drawings. Note that while a hydraulic excavator having a bucket 10 as an attachment at a tip of a work device will be described as an example below, the present invention may be applied to a work machine having other attachment than a bucket. Further, the present invention is also applicable to other work machine than a hydraulic excavator insofar as the work machine has an articulated work device configured by connecting a plurality of front members (an attachment, an arm, a boom, and the like).

In addition, herein, in regard of the meaning of the term "on," "on an upper side of" or "on a lower side of" used together with a term representing a certain shape (e.g., a target surface, and a design surface), "on" means the "surface" having the certain shape, "on an upper side of" means "a position above the surface" having the certain shape, and "on a lower side of" means "a position below the surface" having the certain shape. Besides, in the following description, in the case where there are a plurality of the same constituent elements, an alphabet may be affixed to reference characters (numerals), but the plurality of constituent element may be collectively denoted by omitting the alphabet. For example, where there are two pumps 2*a* and 2*b*, these pumps may be expressed collectively as pumps 2.

<Basic Configuration>

Figure 2:
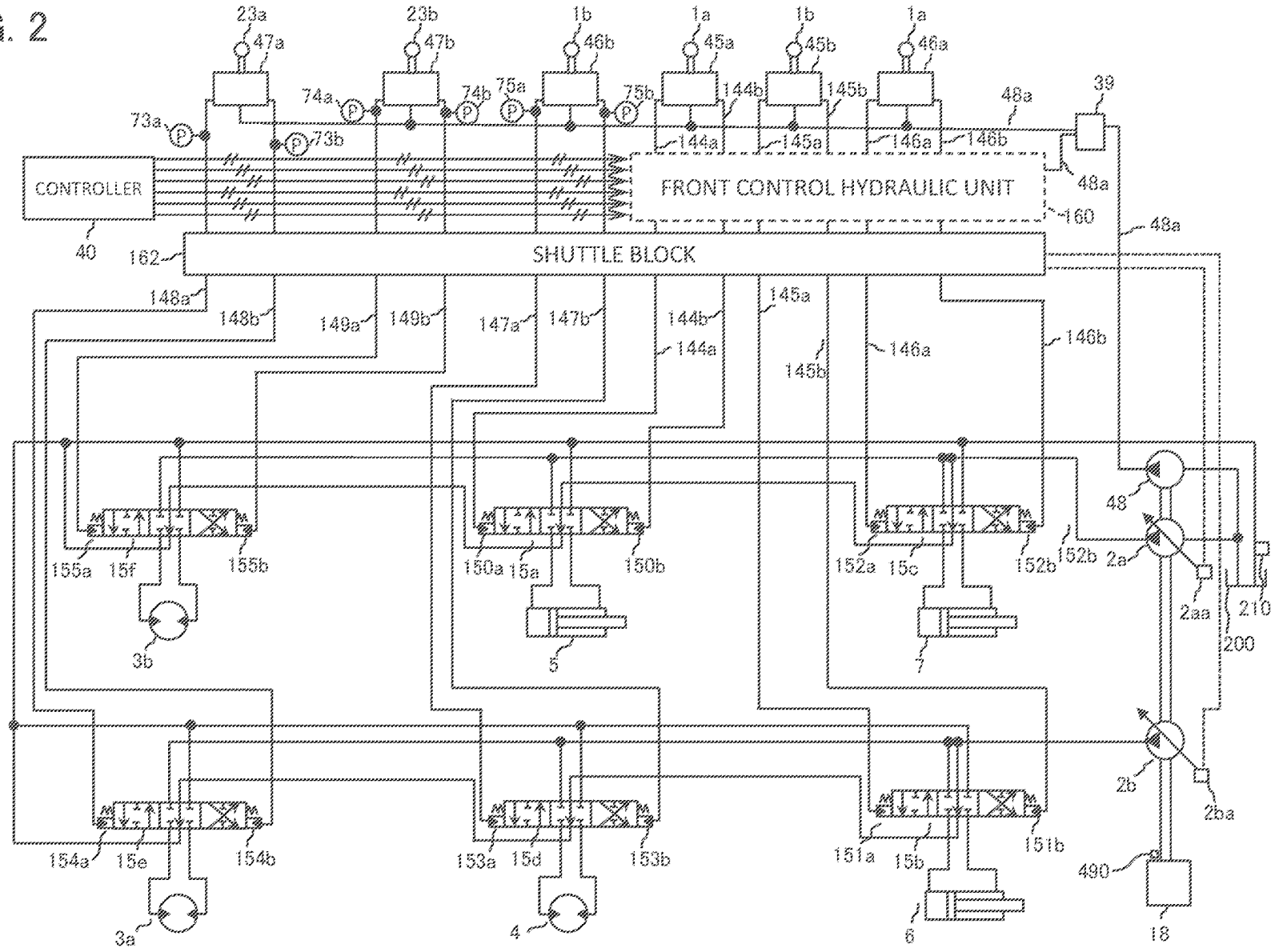
FIG. 2 is a diagram depicting a controller of the hydraulic excavator together with a hydraulic driving device.
Figure 3:
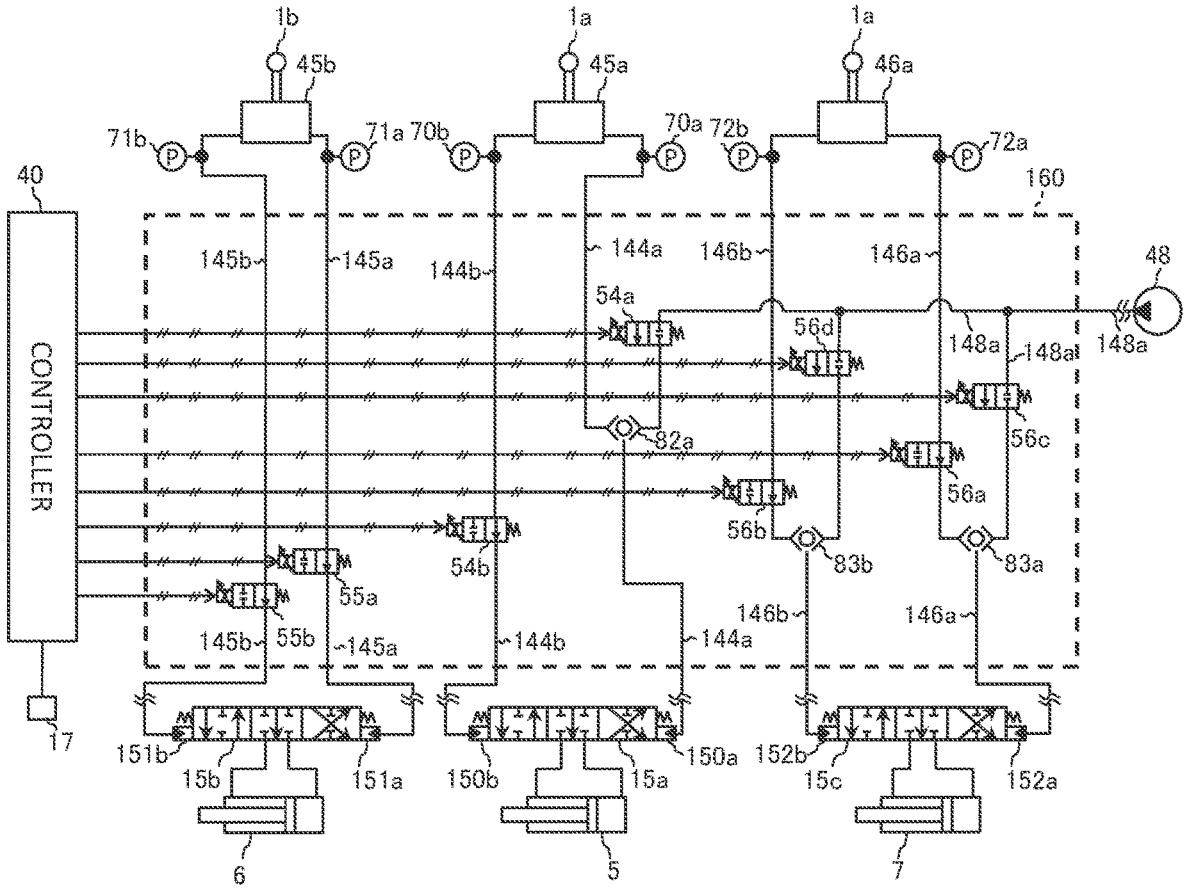
FIG. 3 is a detailed diagram of a front control hydraulic unit.

FIG. 1 is a configuration diagram of a hydraulic excavator according to an embodiment of the present invention, FIG. 2 is a diagram depicting a controller of the hydraulic excavator according to the embodiment of the present invention together with a hydraulic driving device, and FIG. 3 is a detailed diagram of a front control hydraulic unit 160 in FIG. 2.

In FIG. 1, the hydraulic excavator 1 includes an articulated front work device 1A, and a machine body 1B. The machine body 1B includes a lower track structure 11 traveling by left and right traveling hydraulic motors 3*a* (see FIGS. 2) and 3*b*, and an upper swing structure 12 mounted onto the lower track structure 11 and swung by a swing hydraulic motor 4.

The front work device 1A is configured by connecting a plurality of front members (a boom 8, an arm 9 and a bucket 10) which are rotated in perpendicular directions relative to one another. A base end of the boom 8 is rotatably supported on a front portion of the upper swing structure 12 through a boom pin. The arm 9 is rotatably connected to a tip of the boom 8 through an arm pin, and the bucket 10 is rotatably connected to a tip of the arm 9 through a bucket pin. These plurality of front members 8, 9 and 10 are driven by the hydraulic cylinders 5, 6 and 7 which are the plurality of hydraulic actuators. Specifically, the boom 8 is driven by the boom cylinder 5, the arm 9 is driven by the arm cylinder 6, and the bucket 10 is driven by the bucket cylinder 7.

In order that rotational angles $\alpha$, $\beta$ and $\gamma$ (see FIG. 5) as physical quantities concerning the postures of the boom 8, the arm 9 and the bucket 10 can be measured, a boom angle sensor 30 is attached to the boom pin, an arm angle sensor 31 is attached to the arm pin, and a bucket angle sensor 32 is attached to a bucket link 13. Besides, a machine body inclination angle sensor 33 that senses an inclination angle $\theta$ (see FIG. 5) of the upper swing structure 12 (the machine body 1B) relative to a reference plane (for example, a horizontal plane) is attached to the upper swing structure 12. Note that while the angle sensors 30, 31 and 32 in the present embodiment are rotary potentiometers, they can each be replaced by an inclination angle sensor relative to a reference plane (for example, a horizontal plane) or an inertial measurement unit (IMU) or the like.

In a cabin provided on the upper swing structure 12, there are installed an operation device 47*a* (FIG. 2) that has a traveling right lever 23*a* (FIG. 1) and is for operating a traveling right hydraulic motor 3*a* (lower track structure 11), an operation device 47*b* (FIG. 2) that has a traveling left lever 23*b* (FIG. 1) and is for operating a traveling left hydraulic motor 3*b* (lower track structure 11), operation devices 45*a* and 46*a* (FIG. 2) that share an operation right lever 1*a* (FIG. 1) and are for operating the boom cylinder 5 (boom 8) and the bucket cylinder 7 (bucket 10), and operation devices 45*b* and 46*b* (FIG. 2) that share an operation left lever 1*b* (FIG. 1) and are for operating the arm cylinder 6 (arm 9) and the swing hydraulic motor 4 (upper swing structure 12). Hereinafter, the traveling right lever 23*a*, the traveling left lever 23*b*, the operation right lever 1*a* and the operation left lever 1*b* may be generically referred to as operation levers 1 and 23.

An engine 18 as a prime mover mounted on the upper swing structure 12 drives the hydraulic pumps 2*a* and 2*b* and a pilot pump 48. The hydraulic pumps 2*a* and 2*b* are variable displacement pumps whose displacements are controlled by regulators 2*aa* and 2*ba*, whereas the pilot pump 48 is a fixed displacement pump. The hydraulic pumps 2 and the pilot pump 48 suck in a hydraulic working fluid from a tank 200. In the present embodiment, as depicted in FIG. 2, a shuttle block 162 is provided at an intermediate part of pilot lines 144, 145, 146, 147, 148 and 149. Hydraulic signals outputted from the operation devices 45, 46 and 47 are inputted also to the regulators 2*aa* and 2*ba* through the shuttle block 162. While detailed configuration of the shuttle block 162 is omitted, the hydraulic signals are inputted to the regulators 2*aa* and 2*ba* through the shuttle block 162, and the delivery flow rates of the hydraulic pumps 2*a* and 2*b* are controlled according to the hydraulic signals.

A pump line 48*a* as a delivery line of the pilot pump 48 passes through a lock valve 39, is then branched into a plurality of lines, and are connected to valves in the operation devices 45, 46 and 47 and the front control hydraulic unit 160. The lock valve 39 in this example is a solenoid switching valve, and a solenoid driving section thereof is electrically connected to a position sensor for a gate lock lever (not illustrated) disposed in the cabin (FIG. 1). The position of the gate lock lever is sensed by the position sensor, and a signal according to the position of the gate lock lever is inputted from the position sensor to the lock valve 39. When the position of the gate lock lever is in a lock position, the lock valve 39 is closed and communication of the pump line 48*a* is interrupted, whereas when the position of the gate lock lever is in an unlock position, the lock valve 39 is opened and communication of the pump line 48*a* is established. In other words, in a state in which communication of the pump line 48*a* is interrupted, operations by the operation devices 45, 46 and 47 are invalidated, and such operations as swing and excavation are inhibited.

The operation devices 45, 46 and 47 are operation devices of a hydraulic pilot system, and, based on the hydraulic working fluid delivered from the pilot pump 48, generate pilot pressures (also called operation pressures) according to the operation amounts (for example, lever strokes) and operating directions of the operation levers 1, 23 operated by the operator. The thus generated pilot pressures are supplied to hydraulic driving sections 150*a* to 155*b* of corresponding flow control valves 15*a* to 15*f* (FIG. 2 or 3) through pilot lines 144*a* to 149*b* (see FIG. 3), and are utilized as control signals for driving these flow control valves 15*a* to 15*f*.

The hydraulic working fluid delivered from the hydraulic pump 2 is supplied to the traveling right hydraulic motor 3*a*, the traveling left hydraulic motor 3*b*, the swing hydraulic motor 4, the boom cylinder 5, the arm cylinder 6 and the bucket cylinder 7 through the flow control valves 15*a*, 15*b*, 15*c*, 15*d*, 15*e* and 15*f* (see FIG. 2). By the hydraulic working fluid thus supplied, the boom cylinder 5 and the arm cylinder 6 and the bucket cylinder 7 are extended or contracted, whereby the boom 8, the arm 9 and the bucket 10 are each rotated, and the position and posture of the bucket 10 are changed. In addition, by the hydraulic working fluid supplied, the swing hydraulic motor 4 is rotated, whereby the upper swing structure 12 is swung relative to the lower track structure 11. Besides, by the hydraulic working fluid supplied, the traveling right hydraulic motor 3*a* and the traveling left hydraulic motor 3*b* are rotated, to cause the lower track structure 11 to travel.

Figure 16:
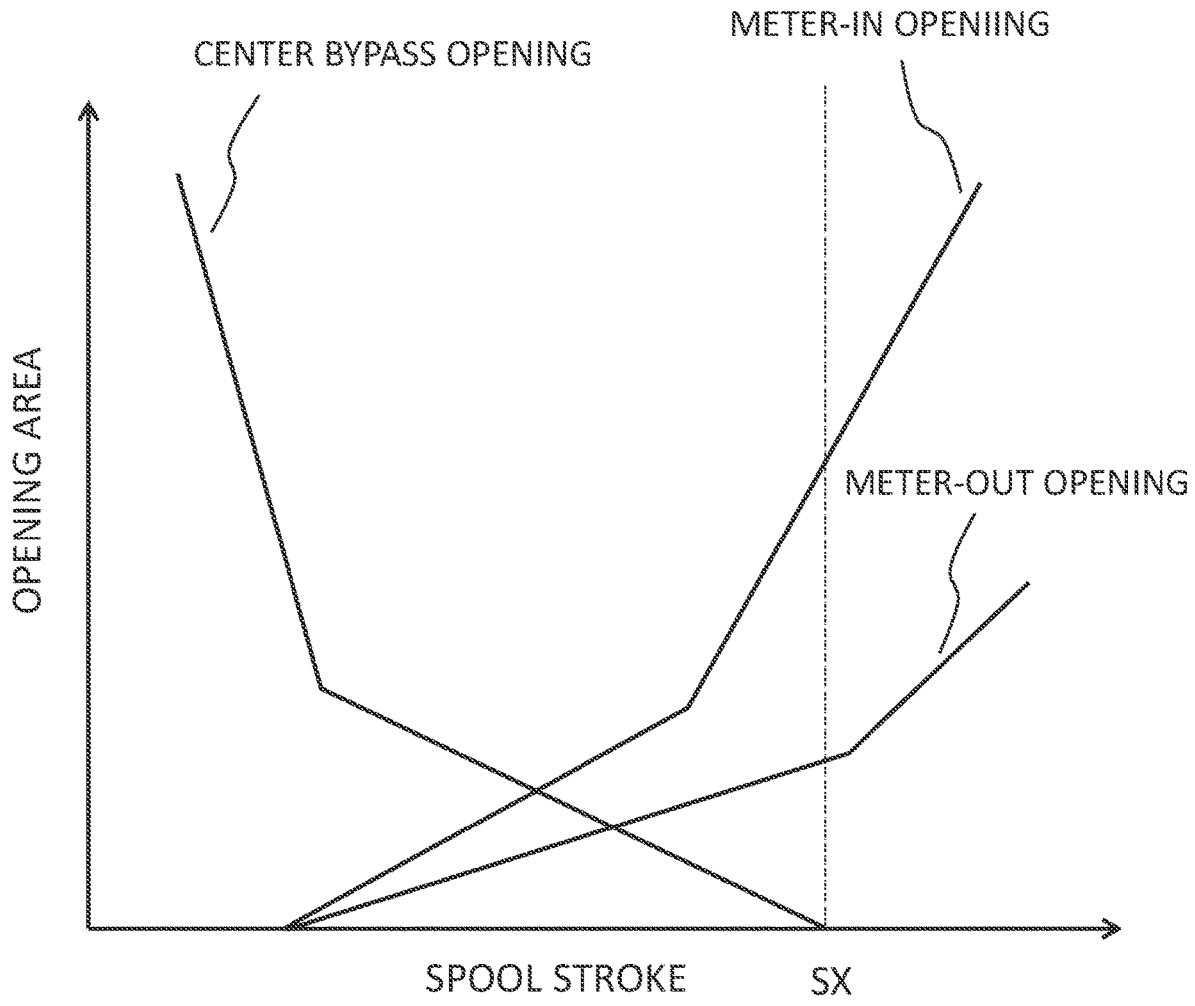
FIG. 16 is a diagram depicting an opening area of a center bypass type spool relative to spool stroke.

The flow control valves 15*a*, 15*b*, 15*c*, 15*d*, 15*e* and 15*f* are flow control valves of an open center bypass system, and when spools are located in neutral positions, the hydraulic working fluid entirely flows through center bypass lines to the tank 200. When the operation levers 1, 23 are operated to displace the spools, a center bypass line (bleed-off opening) is constricted and a line communicating with the actuators (a meter-in opening and a meter-out opening) is opened, as depicted in FIG. 16. When the operation amount is further increased, bleed-off flow rate (namely, bleed-off opening) through the center bypass line decreases, and simultaneously, flow rate to the actuators (namely, meter-in opening and meter-out opening) increases, whereby an actuator velocity according to the operation amount is obtained. When the operation amount is further increased, the center bypass line (bleed-off opening) is completely closed at a certain operation amount (an operation amount corresponding to a closing-up point SX), and the hydraulic working fluid supplied to the flow control valve 15 entirely flows to the corresponding actuator. Note that since FIG. 2 depicts the actual system in a simplified form, there are the flow control valves 15 whose bleed-off lines are not connected to the tank 200 on an illustration basis, but, in practice, all of the flow control valves 15 are flow control valves 15 of the open center bypass system.

The tank 200 is provided with a hydraulic working fluid temperature sensor 210 for sensing the temperature of the hydraulic working fluid for driving the hydraulic actuators. The hydraulic working fluid temperature sensor 210 can also be disposed outside of the tank 200, and, for example, may be attached to an inlet line or an outlet line for the tank 200.

Figure 4:
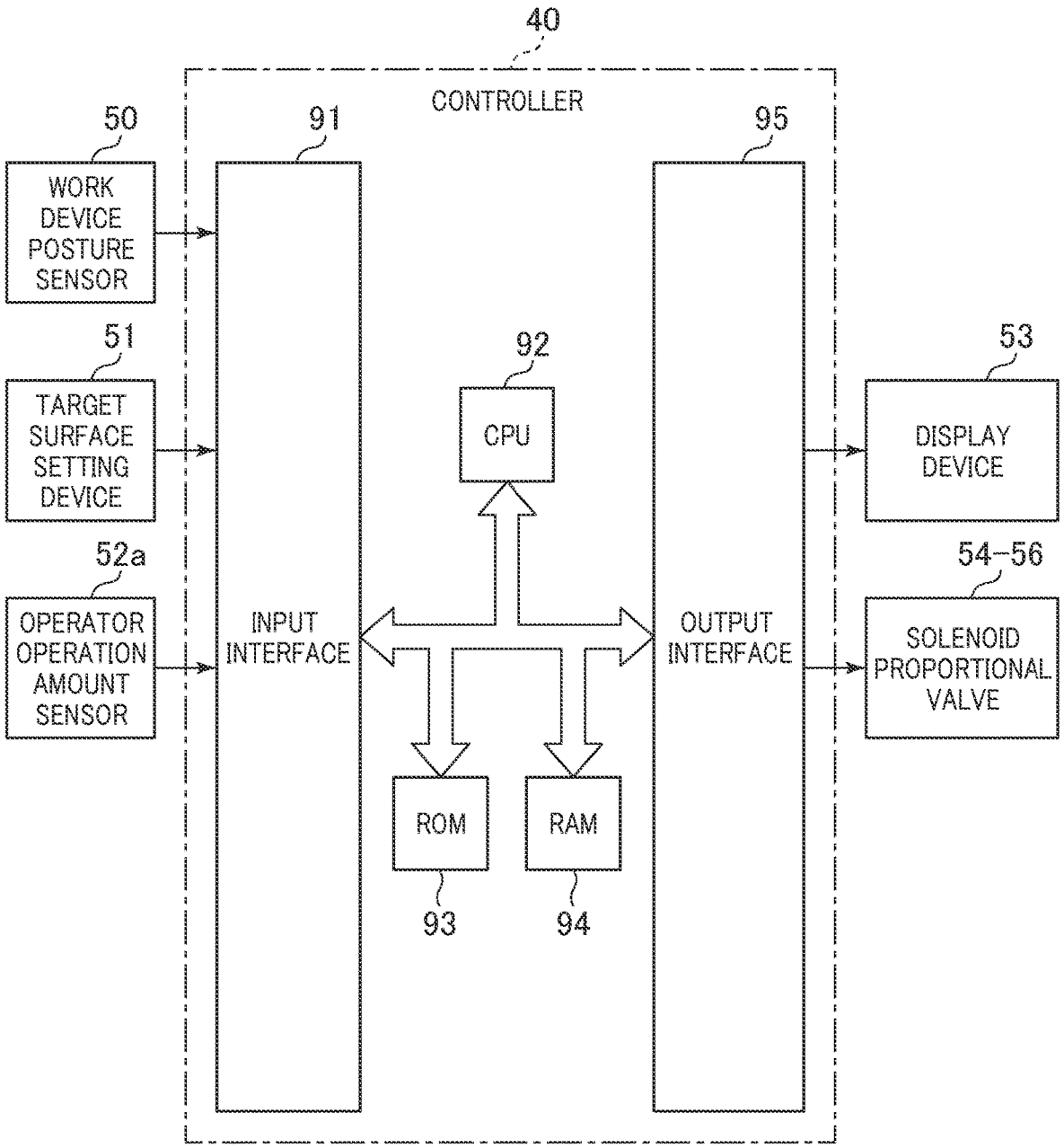
FIG. 4 is a hardware configuration diagram of the controller of the hydraulic excavator.

FIG. 4 is a configuration diagram of a machine control (MC) system possessed by the hydraulic excavator according to the present embodiment. The system of FIG. 4, as MC, performs a processing of controlling the velocity of each of the hydraulic cylinders 5, 6 and 7 and the front work device 1A based on a predetermined condition when the operation devices 45 and 46 are operated by the operator. Herein, the machine control (MC) may be referred to as "semi-automatic control" of controlling the operation of the operation device 1A by a computer only when the operating devices 45 and 46 are operated, in contrast to "automatic control" of controlling the operation of the work device 1A by a computer when the operation devices 45 and 46 are not operated. The details of the MC in the present embodiment will be described below.

As the MC of the front operation device 1A, in the case where an excavating operation (specifically, an instruction on at least one of arm crowding, bucket crowding and bucket dumping) is inputted through the operation devices 45*b* and 46*a*, a control signal (for example, for extending the boom cylinder 5 to forcibly performing a boom raising operation) for forcibly operating at least one of the hydraulic actuators 5, 6 and 7 such that the position of a tip of the work device 1A is held on a target surface 60 and a region on an upper side thereof is outputted to the corresponding one of the flow control valves 15*a*, 15*b* and 15*c*, based on the relation between the target surface 60 (see FIG. 5) and the position of the tip of the work device 1A (in the present embodiment, the claw tip of the bucket 10).

Since the MC prevents the claw tip of the bucket 10 from penetrating to the lower side of the target surface 60, excavation along the target surface 60 can be performed irrespectively of the degree of the operator's skill. Note that while a control point of the front work device 1A at the time of the MC is set at the claw tip of the bucket 10 of the hydraulic excavator (the tip of the work device 1A) in the present embodiment, the control point can be changed to other point than the bucket claw tip insofar as it is a point at the tip portion of the operation device 1A. For example, a bottom surface of the bucket 10 or an outermost portion of the bucket link 13 can also be selected.

The system of FIG. 4 includes a work device posture sensor 50, a target surface setting device 51, an operator operation amount sensor 52*a*, a display device (for example, liquid crystal display) 53 which is disposed in the cabin and is capable of displaying the positional relation between the target surface 600 and the work device 1A, and a controller (controller) 40 which administers MC control.

The work device posture sensor (posture sensor) 50 includes a boom angle sensor 30, an arm angle sensor 31, a bucket angle sensor 32, and a machine body inclination angle sensor 33. These angle sensors 30, 31, 32 and 33 function as posture sensors for sensing physical quantities concerning the postures of the boom 8, the arm 9 and the bucket 10 which are the plurality of front members.

The target surface setting device 51 is an interface capable of inputting information concerning the target surface 60 (inclusive of position information and inclination angle information concerning each target surface). The target surface setting device 51 is connected to an external terminal (not illustrated) in which three-dimensional data of the target surface defined on a global coordinate system (absolute coordinate system) is stored. Note that inputting of the target surface through the target surface setting device 51 may be manually performed by the operator.

The operator operation amount sensor (operation amount sensor) 52*a* includes pressure sensors 70*a*, 70*b*, 71*a*, 71*b*, 72*a* and 72*b* that acquire operation pressures (first control signals) generated in pilot lines 144, 145 and 146 by the operator's operation of the operation levers 1*a* and 1*b* (operation devices 45*a*, 45*b* and 46*a*). These pressure sensors 70*a*, 70*b*, 71*a*, 71*b*, 72*a* and 72*b* function as operation amount sensors that sense physical quantities concerning the operator's operation amounts of the boom 7 (boom cylinder 5), the arm 8 (arm cylinder 6) and the bucket 9 (bucket cylinder 7) through the operation devices 45*a*, 45*b* and 46*a*.

<Front Control Hydraulic Unit 160>

As illustrated in FIG. 3, the front control hydraulic unit 160 includes: pressure sensors 70*a* and 70*b* that are provided in pilot lines 144*a* and 144*b* of the operation device 45*a* for the boom 8 and that sense a pilot pressure (first control signal) as an operation amount of the operation lever 1*a*; a solenoid proportional valve 54*a* that is connected on primary port side thereof to the pilot pump 48 through a pump line 148*a* and outputs a pilot pressure from the pilot pump 48 with pressure reduction; a shuttle valve 82*a* that is connected to the pilot line 144*a* of the operation device 45*a* for the boom 8 and a secondary port side of the solenoid proportional valve 54*a*, that selects the high pressure side one of a pilot pressure in the pilot line 144*a* and a control pressure (second control signal) outputted from the solenoid proportional valve 54*a*, and that guides the selected pressure to the hydraulic driving section 150*a* of the flow control valve 15*a*; and a solenoid proportional valve 54*b* that is disposed in the pilot line 144*b* of the operation device 45*a* for the boom 8 and that reduces and outputs the pilot pressure (first control signal) in the pilot line 144*b* based on a control signal from the controller 40.

In addition, the front control hydraulic unit 160 is provided with: pressure sensors 71*a* and 71*b* that are disposed in the pilot lines 145*a* and 145*b* for the arm 9, that sense a pilot pressure (first control signal) as an operation amount of the operation lever 1*b*, and that output the pilot pressure to the controller 40; a solenoid proportional valve 55*b* that is disposed in the pilot line 145*b* and reduces and outputs the pilot pressure (first control signal) based on a control signal from the controller 40; and a solenoid proportional valve 55*a* that is disposed in the pilot line 145*a* and reduces and outputs the pilot pressure (first control signal) based on a control signal from the controller 40.

Besides, the front control hydraulic unit 160 is provided in pilot lines 146*a* and 146*b* for the bucket 10 with: pressure sensors 72*a* and 72*b* that sense the pilot pressure (first control signal) as the operation amount of the operation lever 1*a* and output the pilot pressure to the controller 40; solenoid proportional valves 56*a* and 56*b* that reduce and output the pilot pressure (first control signal) based on a control signal from the controller 40; solenoid proportional valves 56*c* and 56*d* that are connected on a primary port side thereof to the pilot pump 48 and reduce and output a pilot pressure from the pilot pump 48; and shuttle valves 83*a* and 83*b* that select a high pressure side one of the pilot pressure in the pilot lines 146*a* and 146*b* and a control pressure outputted from the solenoid proportional valves 56*c* and 56*d* and guide the selected pressure to the hydraulic driving sections 152*a* and 152*b* of the flow control valve 15*c*. Note that in FIG. 3, connection wires for the pressure sensors 70, 71 and 72 and the controller 40 are omitted for want of space.

The solenoid proportional valves 54*b*, 55*a*, 55*b*, 56*a* and 56*b* have their openings at maximum when not energized, and the openings are reduced as a current as a control signal from the controller 40 is increased. On the other hand, the solenoid proportional valves 54*a*, 56*c* and 56*d* have their openings at zero when not energized, have their openings when energized, and the openings are enlarged as the current (control signal) from the controller 40 is increased. In this way, the openings of the solenoid proportional valves 54, 55 and 56 are ones according to the control signal from the controller 40.

In the control hydraulic unit 160 configured as above, when the control signals are outputted from the controller 40 to drive the solenoid proportional valves 54*a*, 56*c* and 56*d*, a pilot pressure (second control signal) can be generated even in the case where operator's operation of the corresponding operation devices 45*a* and 46*a* is absent; therefore, a boom raising operation, a bucket crowding operation and a bucket dumping operation can be forcibly generated. In addition, when the solenoid proportional valves 54*b*, 55*a*, 55*b*, 56*a* and 56*b* are driven by the controller 40 similarly to this, a pilot pressure (second control signal) obtained by reducing the pilot pressure (first control signal) generated by the operator's operation of the operation devices 45*a*, 45*b* and 46*a* can be generated; therefore, the velocities of a boom lowering operation, an arm crowding/dumping operation and a bucket crowding/dumping operation can be forcibly reduced from the values according to the operator's operation.

Herein, of the control signals for the flow control valves 15*a* to 15*c*, the pilot pressure generated by operation of the operating devices 45*a*, 45*b* and 46*a* is referred to as the "first control signal." Of the control signals for the flow control valves 15*a* to 15*c*, a pilot pressure generated by driving the solenoid proportional valves 54*b*, 55*a*, 55*b*, 56*a* and 56*b* by the controller 40 and correcting (reducing) the first control signal and a pilot pressure newly generated separately from the first control signal by driving the solenoid proportional valves 54*a*, 56*c* and 56*d* by the controller 40 are referred to as the "second control signals."

The second control signals are generated when the velocity vector of the control point of the operation device 1A generated by the first control signal is contrary to a predetermined condition, and is generated as a control signal for generating a velocity vector of a control point of the operation device 1A suitable for the predetermined condition. Note that in the case where the first control signal is generated for a hydraulic driving section on one side in the same flow control valve 15*a* to 15*c* and the second control signal is generated for a hydraulic driving section on the other side, the second control signal is preferentially made to act on the hydraulic driving section, the first control signal is interrupted by the solenoid proportional valve, and the second control signal is inputted to the hydraulic driving section on the other side. Therefore, of the flow control valves 15*a* to 15*c*, those for which the second control signal has been calculated are controlled based on the second control signal, whereas those for which the second control signal has not been calculated are controlled based on the first control signal, and those for which both the first and second control signals have not been generated are not controlled (driven). When the first control signal and the second control signal are defined as above-mentioned, the MC can also be said to be a control of the flow control valves 15*a* to 15*c* based on the second control signal.

<Controller 40>

In FIG. 4, the controller 40 includes an input section 91, a central processing unit (CPU) 92 as a processor, a read only memory (ROM) 93 and a random access memory (RAM) 94 as storage devices, and an output section 95. The input section 91 receives as inputs a signal from the angle sensors 30 to 32 and the inclination angle sensor 33 as the work device posture sensor 50, a signal from the target surface setting device 51 as a device for setting the target surface 600, and a signal from the operator operation amount sensor 52*a* as pressure sensors (inclusive of pressure sensors 70, 71 and 72) for sensing the operation amounts from the operation devices 45*a*, 45*b* and 46*a*, and converts the signals into a form which can be calculated by the CPU 92. The ROM 93 is a recording medium in which are stored a control program for executing the MC inclusive of a processes according to a flow chart to be described later, and various information necessary for execution of the flow chart. The CPU 92 performs a predetermined calculation process on the signals taken in from the input section 91 and the memories 93 and 94 according to the control program stored in the ROM 93. The output section 95 generates output signals according to the results of calculation in the CPU 92, and outputs the signals to the solenoid proportional valves 54 to 56 or the display device 53, to thereby drive and/or control the hydraulic actuators 5 to 7 or display images of the machine body 1B, the bucket 10 and the target surface 60 and the like on a screen of the display device 53.

Note that while the controller 40 in FIG. 4 includes semiconductor memories of the ROM 93 and the RAM 94 as storage devices, they can be particularly replaced by other storage devices; for example, a magnetic storage device such as a hard disk drive may be provided.

Figure 6:
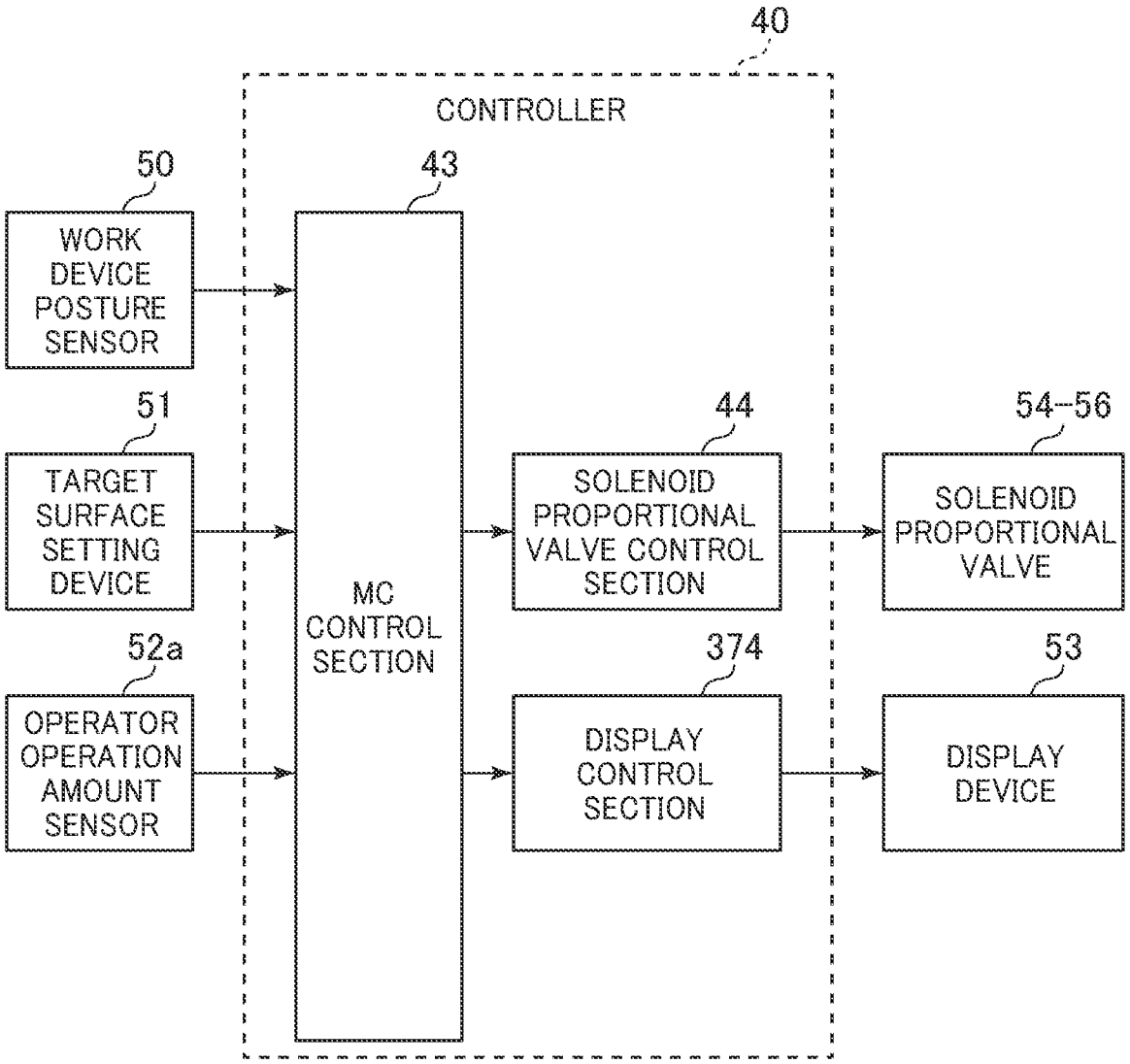
FIG. 6 is a functional block diagram of the controller of the hydraulic excavator of FIG. 1.

FIG. 6 is a functional block diagram of the controller 40. The controller 40 includes an MC control section 43, a solenoid proportional valve control section 44, and a display control section 374.

The display control section 374 is a section that controls the display device 53 based on a work device posture and a target surface outputted from the MC control section 43. The display control section 374 includes a display ROM storing therein a multiplicity of display-related data including an image of the work device 1A and icons, and the display control section 374 reads a predetermined program based on a flag contained in input information, and controls display on the display device 53.

Figure 7:
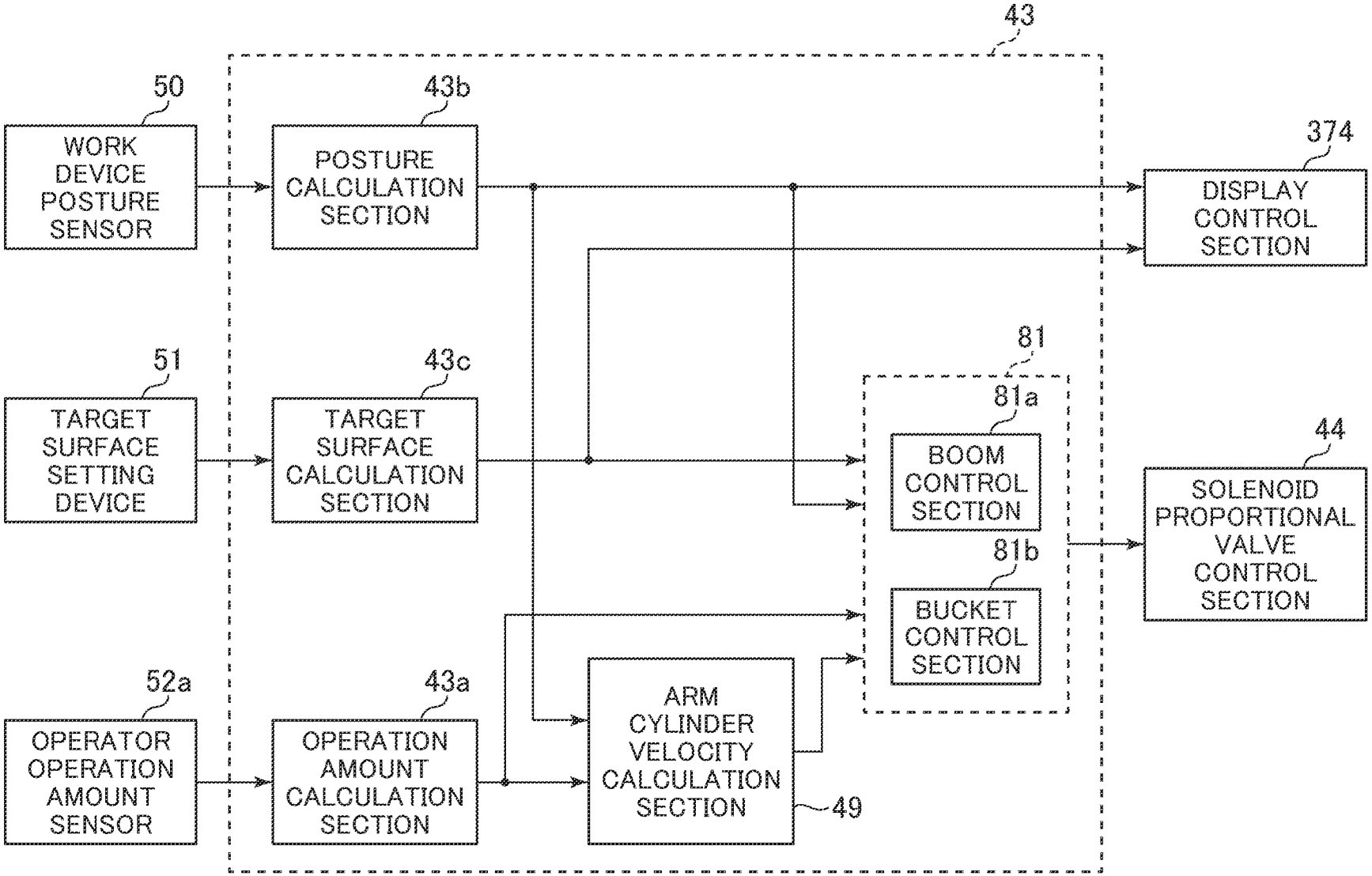
FIG. 7 is a functional block diagram of an MC control section in FIG. 6.

FIG. 7 is a functional block diagram of the MC control section 43 in FIG. 6. The MC control section 43 includes an operation amount calculation section 43*a*, a posture calculation section 43*b*, a target surface calculation section 43*c*, an arm cylinder velocity calculation section 49, and an actuator control section 81 (a boom control section 81*a* and a bucket control section 81*b*).

The operation amount calculation section 43*a* calculates operation amounts of the operation devices 45*a*, 45*b* and 46*a* (operation levers 1*a* and 1*b*) based on sensed values from the operator operation amount sensor 52*a*. In other words, the operation amounts of the operation devices 45*a*, 45*b* and 46*a* can be calculated from the sensed values from the pressure sensors 70, 71 and 72.

Note that utilization of the pressure sensors 70, 71 and 72 for calculation of the operation amounts is merely an example; for example, operation amounts of the operation levers of the operation devices 45*a*, 45*b* and 46*a* may be sensed by position sensors (for example, rotary encoders) that sense rotational displacements of the operation levers.

The posture calculation section 43*b* calculates the postures of the boom 8, the arm 9 and the bucket 10, the posture of the front work device 1A and the position of the claw tip of the bucket 10 in a local coordinate system, based on sensed values from the work device posture sensor 50. In addition, the posture calculation section 43*b* calculates an angle (that may be referred to as "arm horizontal angle φ" (see FIG. 5)) formed between a horizontal plane passing through the arm rotational center (arm pin) and the arm 9.

Figure 5:
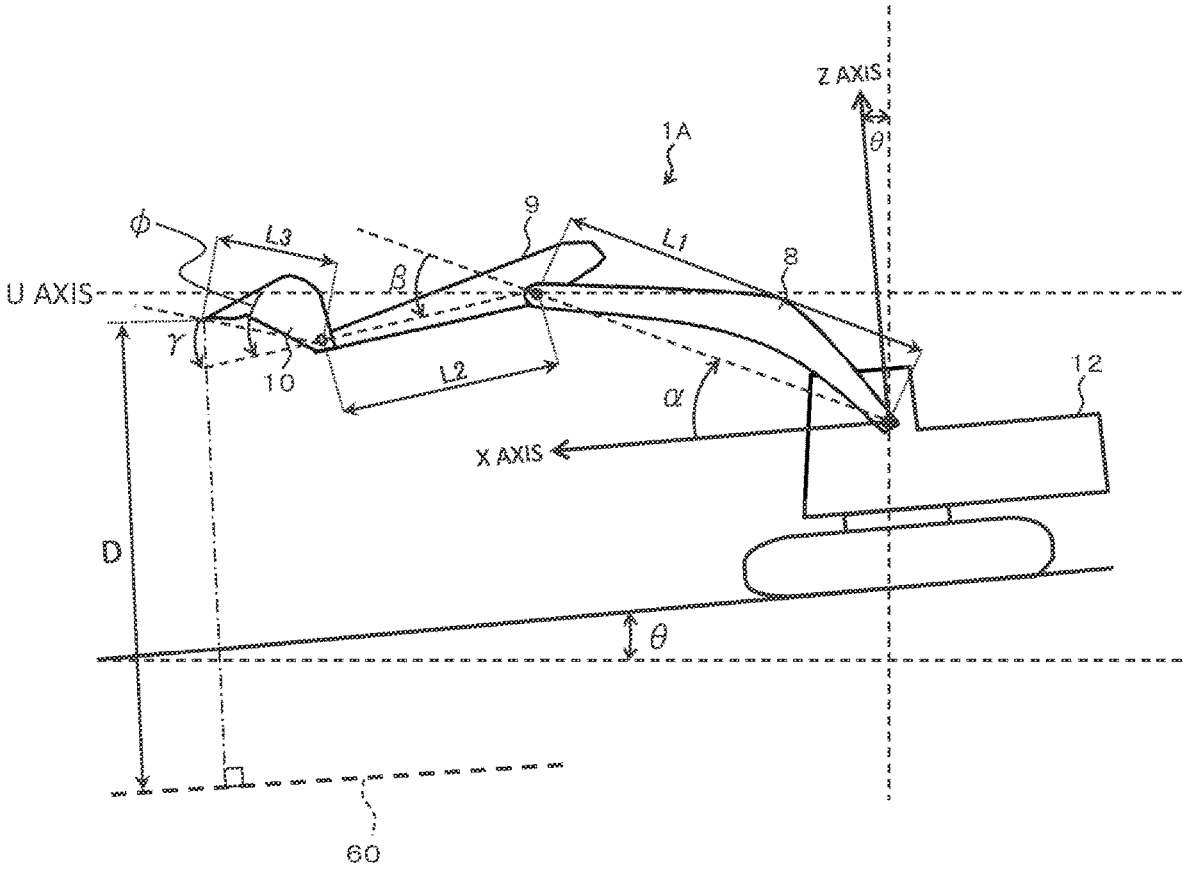
FIG. 5 is a diagram depicting a coordinate system in the hydraulic excavator of FIG. 1 and a target surface.

The postures of the boom 8, the arm 9 and the bucket 10 and the posture of the front work device 1A can be defined on an excavator coordinate system (local coordinate system) of FIG. 5. The excavator coordinate system (XZ coordinate system) of FIG. 5 is a coordinate system set on the upper swing structure 12, in which a base bottom portion of the boom 8 rotatably supported on the upper swing structure 12 is set as an origin, a Z axis is set in the vertical direction of the upper swing structure 12, and an X axis is set in a horizontal direction of the upper swing structure 12. The inclination angle of the boom 8 relative to the X axis is boom angle α, the inclination angle of the arm 9 relative to the boom 8 is arm angle β, and the inclination angle of the bucket claw tip relative to the arm 9 is bucket angle γ. The inclination angle of the machine body 1B (upper swing structure 12) relative to a horizontal plane (reference plane) is inclination angle θ. The boom angle α is sensed by a boom angle sensor 30, the arm angle β by an arm angle sensor 31, the bucket angle γ by a bucket angle sensor 32, and the inclination angle θ is sensed by a machine body inclination angle sensor 33. Let the lengths of the boom 8, the arm 9 and the bucket 10 be L1, L2 and L3 respectively as prescribed in FIG. 5, then the coordinates of the bucket claw tip and the postures of the boom 8, the arm 9 and the bucket 10 and the posture of the work device 1A in the excavator coordinate system can be represented by L1, L2, L3, α, β and γ.

In addition, in FIG. 5, the arm horizontal angle φ that is the angle formed between the horizontal plane passing through the arm rotational center (arm pin) and the arm 9 can be calculated, for example, from the inclination angle θ, the boom angle α and the arm angle β. In the present embodiment, a U axis is set on the horizontal plane passing through the arm rotational center (arm pin) in a global coordinate system as depicted in FIG. 5, and the angle formed between a straight line (a straight line having a length of L2) connecting the arm rotational center and the bucket rotational center and the U axis is φ. With the U axis set 0 degrees, a counterclockwise angle is a positive angle, and a clockwise angle is a negative angle. The angle φ in FIG. 5 is positive. Note that the arm horizontal angle φ can also be sensed by attaching an inclination sensor or an inertial measurement unit (IMU) or the like relative to a reference plane (for example, a horizontal plane) to the arm 9.

The target surface calculation section 43*c* calculates position information concerning the target surface 60 based on information from the target surface setting device 51, and stores the position information in the ROM 93. In the present embodiment, as illustrated in FIG. 5, a sectional shape obtained upon cutting a three-dimensional target surface by a plane of movement of the work device 1A (an operating plane of the work implement) is utilized as the target surface 60 (a two-dimensional target surface).

Note that while there is one target surface 60 in the example of FIG. 5, there may be a plurality of target surfaces. In the case where there are a plurality of target surfaces, for example, the target surface the closest to the work device 1A may be set as a target surface, or the target surface located on a lower side of the bucket claw tip may be set as a target surface, or an arbitrarily selected one of the target surfaces may be set as a target surface.

The arm cylinder velocity calculation section 49 is a section that calculates a velocity (arm cylinder velocity) utilized as a velocity of the arm cylinder 6 when the actuator control section 81 executes the MC, and that outputs the calculation result to the actuator control section 81.

Figure 8:
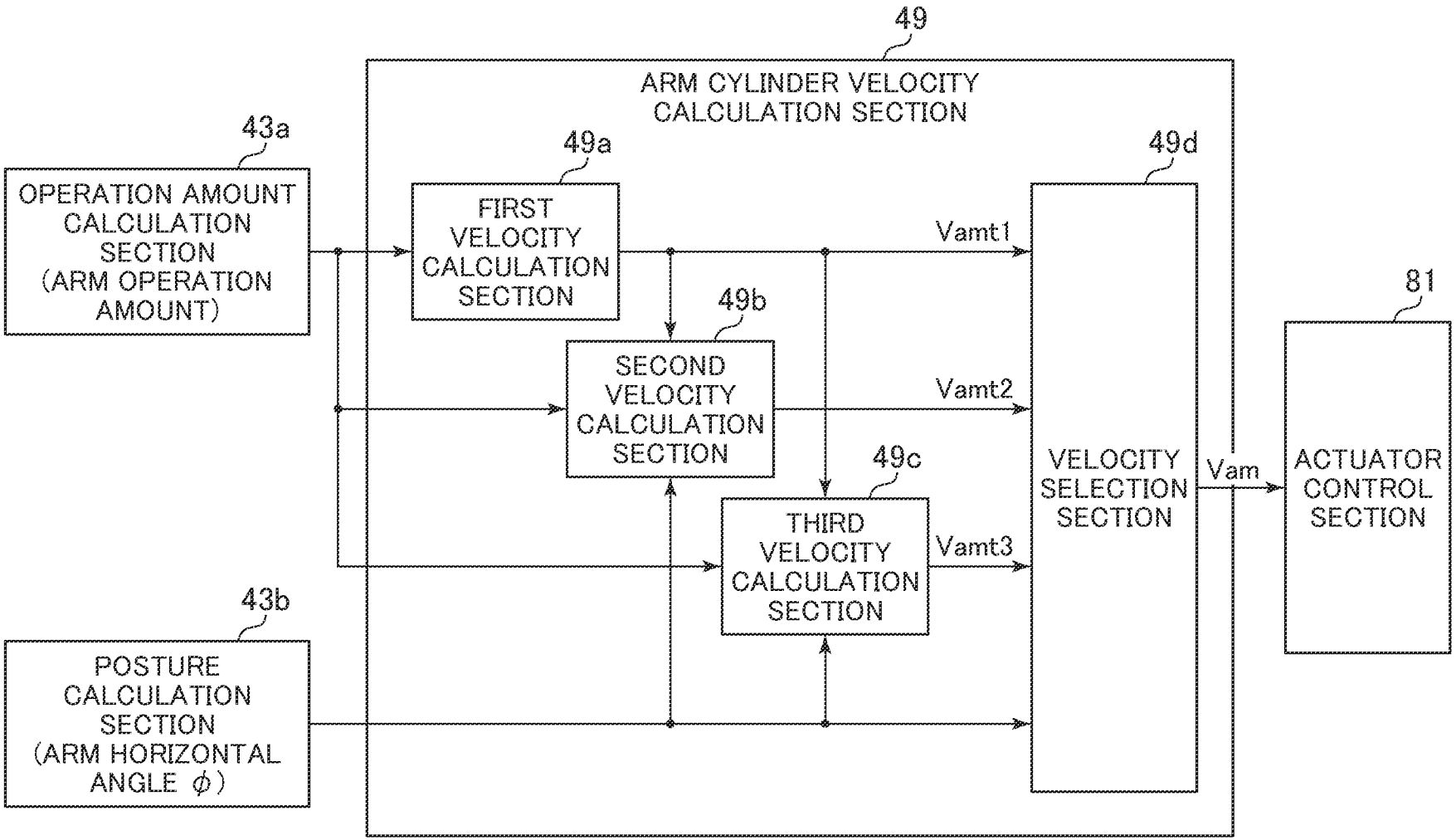
FIG. 8 is a functional block diagram of an arm cylinder velocity calculation section 49 in FIG. 7.

FIG. 8 is a functional block diagram of the arm cylinder velocity calculation section 49. The arm cylinder velocity calculation section 49 includes a first velocity calculation section 49*a*, a second velocity calculation section 49*b*, a third velocity calculation section 49*c*, and a velocity selection section 49*d*.

Figure 9:
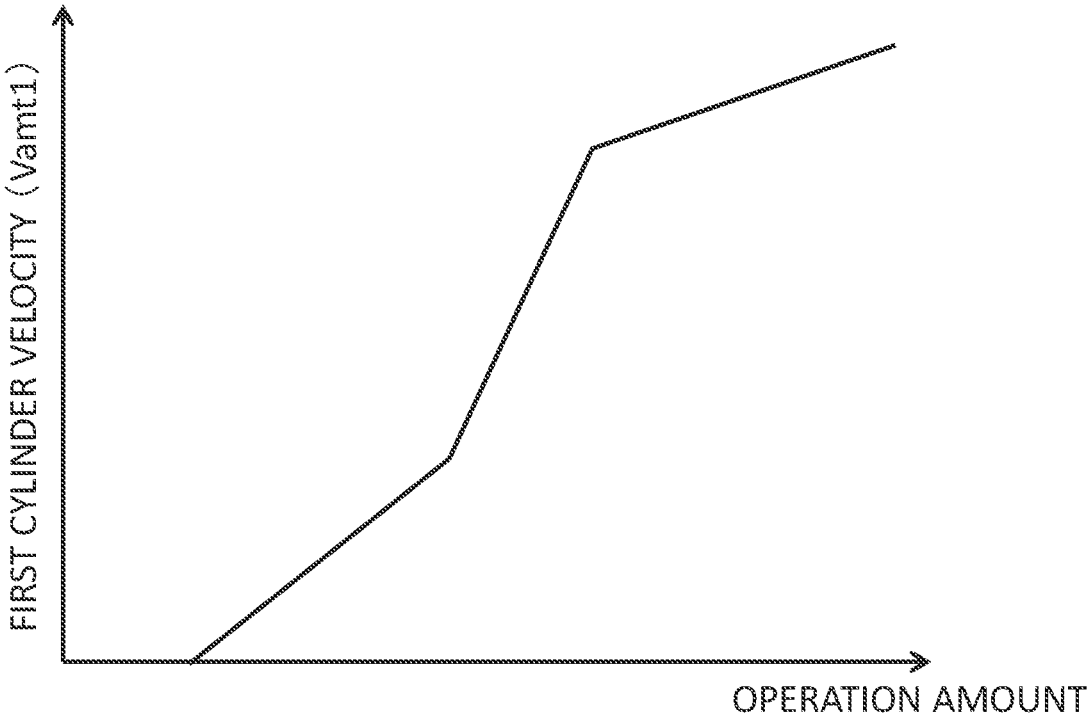
FIG. 9 is a diagram representing the relation of cylinder velocity to an operation amount.

The first velocity calculation section 49*a* is a section that calculates a velocity (Vamt1) of the arm cylinder 6 from a sensed value of operation amount for the arm 9, of sensed values from the operator operation amount sensor 52*a*. Herein, the velocity (Vamt1) of the arm cylinder 6 calculated by the first velocity calculation section 49*a* may be referred to as "first velocity" or "first arm cylinder velocity." In the present embodiment, the operation amount calculation section 43*a* calculates an arm operation amount from a sensed value of the arm operation amount by the operator operation amount sensor 52*a*. The first velocity calculation section 49*a* calculates the velocity (Vamt1) of the arm cylinder 6, based on the arm operation amount calculated by the operation amount calculation section 43*a* and a table of FIG. 9 in which the correlation between arm operation amount and arm cylinder velocity is prescribed on a one-to-one basis. In the table of FIG. 9, the correlation between operation amount and velocity is prescribed in such a manner that the arm cylinder velocity monotonously increases with an increased in the arm operation amount, based on the cylinder velocity relative to the operation amount preliminarily determined empirically or by simulation. The first arm cylinder velocity calculated by the first calculation section 49*a* is outputted to the velocity selection section 49*d*.

The second velocity calculation section 49*b* is a section that calculates a velocity (which may be referred to as second velocity or second arm cylinder velocity) lower than the first arm cylinder (Vamt1), calculated by the first velocity calculation section 49*a*, as a velocity (Vamt2) of the arm cylinder 6, taking into account the weight of an object to be driven by the arm cylinder 6 (the arm 9 and an assembly of various members located on the bucket 10 side of the arm 9, inclusive of the bucket 10 and the bucket cylinder 7). While a specific example will be described later, the second arm cylinder velocity (Vamt2) in the present embodiment is defined as a value obtained by subtracting a predetermined correction value prescribed by the arm operation amount and the arm horizontal angle φ from the first arm cylinder velocity (Vamt1), assuming a situation in which the direction of a load exerted on the arm cylinder 6 by the weight of the object to be driven by the arm cylinder 6 is opposite to the driving direction of the arm cylinder, namely, a situation in which the actual velocity of the arm cylinder 6 is decelerated as compared to the first velocity (Vamt1) due to the weight of the object to be driven. The predetermined correction value (namely, the magnitude of the difference between the first velocity and the second velocity) is preferably set to be equal to or less than a maximum value of the velocity value to which the first velocity can be reduced due to the influence of the weight of the object to be driven. The second arm cylinder velocity (Vamt2) calculated by the second velocity calculation section 49*b* is outputted to the velocity selection section 49*d*.

The third velocity calculation section 49*c* is a section that calculates a velocity (which may be referred to as third velocity or third arm cylinder velocity) higher than the first arm cylinder velocity (Vamt1), calculated by the first velocity calculation section 49*a*, as a velocity (Vamt3) of the arm cylinder 6, taking into account the weight of the target to be driven by the arm cylinder 6. While a specific example will be described later, the third arm cylinder velocity (Vamt3) in the present embodiment is defined as a value obtained by adding a predetermined correction value prescribed by the arm operation amount and the arm horizontal angle φ to the first arm cylinder velocity (Vamt1), assuming a situation in which the direction of a load exerted on the arm cylinder 6 by the weight of the object to be driven by the arm cylinder 6 is the same as the driving direction of the arm cylinder, namely, a situation in which the velocity of the arm cylinder 6 is accelerated as compared to the first velocity (Vamt1) due to the weight of the object to be driven. The predetermined correction value (namely, the magnitude of the difference between the first velocity and the third velocity) is preferably set to be equal to or less than a maximum value of a velocity value to which the first velocity can be accelerated due to the influence of the weight of the object to be driven. The third arm cylinder velocity (Vamt3) calculated by the third velocity calculation section 49*c* is outputted to the velocity selection section 49*d*.

The velocity selection section 49*d* is a section that determines the direction of a load exerted on the arm cylinder 6 by the weight of the object to be driven by the arm cylinder 6 inclusive of the arm 9 (the direction may be referred to as "load direction of the object to be driven") based on a sensed value (specifically, the arm horizontal angle ( ) from the posture sensor 43*b*, and selects one of the first velocity (Vamt1), the second velocity (Vamt2) and the third velocity (Vamt3) as an arm cylinder velocity Vam to be outputted to the actuator control section 81. While the details will be described later, the velocity selection section 49*d* can output the second velocity (Vamt2) to the actuator control section 81 when it determines that the load direction of the object to be driven is opposite to the driving direction of the arm cylinder 6, and can output the third velocity (Vamt3) to the actuator control section 81 when it determines that the load direction of the object to be driven is the same as the driving direction of the arm cylinder 6.

The boom control section 81*a* and the bucket control section 81*b* constitute the actuator control section 81 that controls at least one of a plurality of hydraulic actuators 5, 6 and 7 according to a predetermined condition when the operation devices 45*a*, 45*b* and 46*a* are operated. The actuator control section 81 calculates target pilot pressures for the flow control valves 15*a*, 15*b* and 15*c* of the hydraulic cylinders 5, 6 and 7, and outputs the thus calculated target pilot pressures to the solenoid proportional valve control section 44.

The boom control section 81*a* is a section that executes the MC for controlling the operation of the boom cylinder 5 (boom 8) in such a manner that the claw tip (control point) of the bucket 10 is located on or on an upper side of the target surface 60, based on the position of the target surface 60, the posture of the front work device 1A, the position of the claw tip of the bucket 10, and the velocities of the hydraulic cylinders 5, 6 and 7 when the operation devices 45*a*, 45*b* and 46*a* are operated. The boom control section 81*a* calculates a target pilot pressure for the flow control valve 15*a* of the boom cylinder 5. The details of the MC by the boom control section 81*a* will be described later using FIG. 13.

The bucket control section 81*b* is a section for carrying out a bucket angle control by MC when the operation devices 45*a*, 45*b* and 46*a* are operated. Specifically, when the distance between the target surface 60 and the claw tip of the bucket 10 is equal to or less than a predetermined value, MC (bucket angle control) for controlling the operation of the bucket cylinder 7 (bucket 10) in such a manner that the angle θ of the bucket 10 relative to the target surface 60 becomes a preset bucket angle θTGT relative to the target surface. The bucket control section 81*b* calculates a target pilot pressure for the flow control valve 15*c* of the bucket cylinder 7.

The solenoid proportional valve control section 44 calculates commands for the solenoid proportional valves 54 to 56, based on target pilot pressures for the flow control valves 15*a*, 15*b* and 15*c* outputted from the actuator control section 81. Note that in the case where the pilot pressure (first control signal) based on an operator's operation and the target pilot pressure calculated by the actuator control section 81 coincide with each other, the current value (command value) to the relevant solenoid proportional valve 54 to 56 is zero, and an operation of the relevant solenoid proportional valve 54 to 56 is not performed.

<Flow of Arm Cylinder Velocity Calculation by Arm Cylinder Velocity Calculation Section 49>

Figure 10:
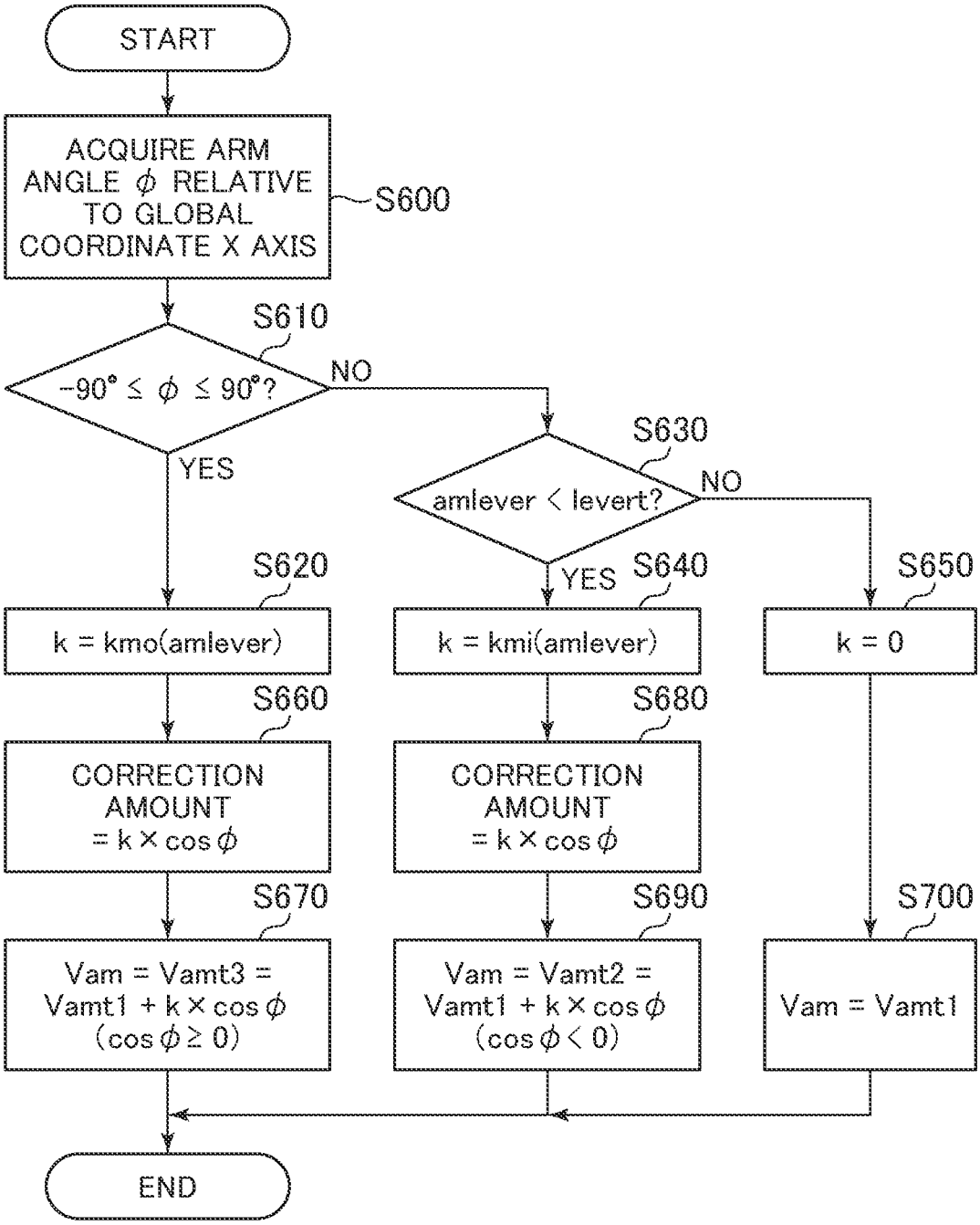
FIG. 10 is a flow chart for calculation of arm cylinder velocity.

FIG. 10 depicts a flow chart of calculation of the velocity Vam of the arm cylinder 6 that the arm cylinder velocity calculation section 49 outputs to the actuator control section 81. The arm cylinder velocity calculation section 49 executes the flow of FIG. 10 repeatedly at a predetermined control period. Note that in the flow described below, the velocities (Vamt1, Vamt2 and Vamt3) as objects to be outputted are calculated after the selection of the velocity by the velocity selection section 49*d* is performed. It is natural, however, that the flow is configured such that the arm cylinder velocities (Vamt1, Vamt2 and Vamt3) may be preliminarily calculated respectively by the first velocity calculation section 49*a*, the second velocity calculation section 49*b* and the third velocity calculation section 49*c* before selection of the velocity by the velocity selection section 49*d*, and, after completion of the determining process by the velocity selection section 49*d*, only the arm cylinder velocity according to the determination result may be outputted to the actuator control section 81.

In S600, the velocity selection section 49*d* acquires an arm horizontal angle φ (see FIG. 5) from the posture calculation section 43*b*.

In S610, the velocity selection section 49*d* determines whether or not the arm angle φ acquired in S600 is equal to or more than −90 degrees and equal to or less than 90 degrees.

In the case where the determination in S610 is YES (namely, in the case where (is equal to or more than −90 degrees and equal to or less than 90 degrees), it is determined that the direction of a load exerted on the arm cylinder 6 by the weight of the object to be driven is the same as the driving direction of the arm cylinder 6, the velocity selection section 49*d* determines to output the third velocity (Vamt3) as the arm cylinder velocity Vam to the actuator control section 81, and the control proceeds to S620.

In S620, the third velocity calculation section 49*c* calculates a correction gain k concerning the arm cylinder velocity Vamt3 based on an arm operation amount amlever calculated by the operation amount calculation section 43*a*. Here, a function kmo for calculation of the correction gain k by the third velocity calculation section in S620 is made to be a function correlated with a meter-out opening area of an arm spool, considering that the influence of the weight of the object to be driven by the arm cylinder 6 is derived from the meter-out opening area of the arm spool concerning the flow control valve 15*b*.

Figure 11:
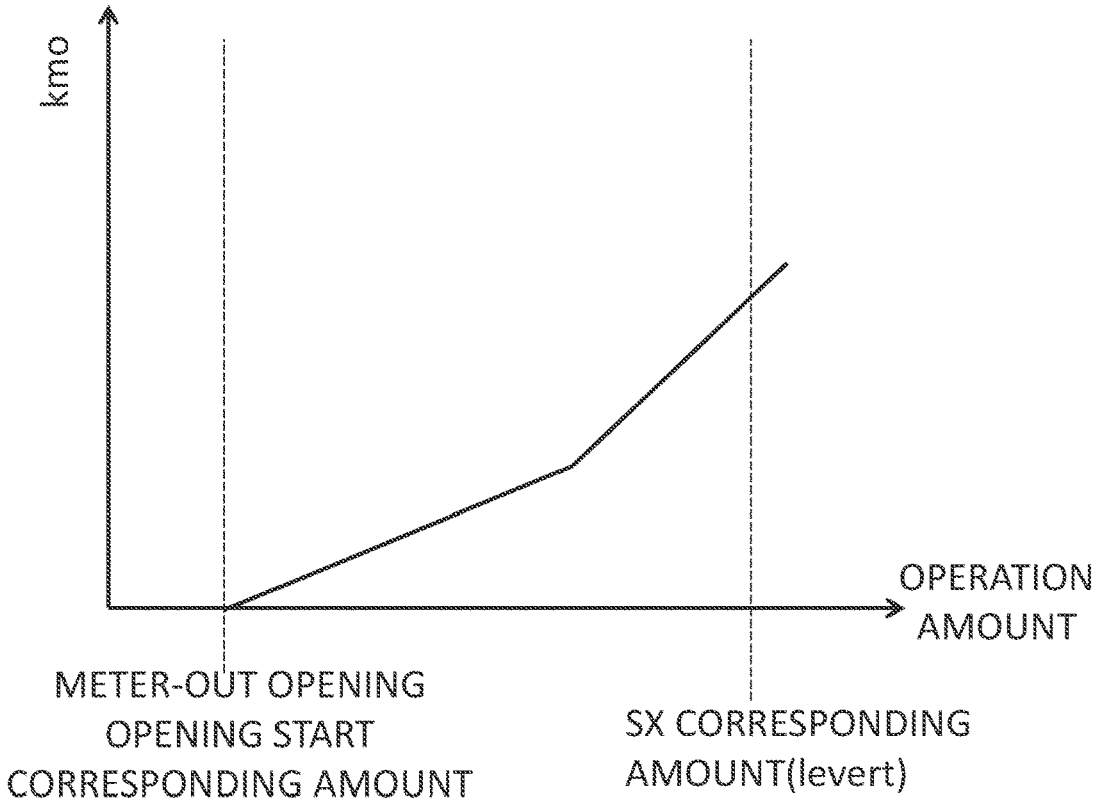
FIG. 11 is a diagram representing the relation between arm operation amount and a correction gain kmo.

In the present embodiment, it is presumed that the meter-out opening area of the arm spool is converted into an arm operation amount (amlever) corresponding thereto, and the third velocity calculation section 49*c* calculates the correction gain k based on the arm operation amount (amlever) calculated by the operation amount calculation section 43*a* and a table in FIG. 11 in which the correlation between the arm operation amount (amlever) and the correction gain k (function kmo) is prescribed on a one-to-one basis. In the table in FIG. 11, the correlation between the operation amount and the correction gain k is prescribed in such a manner that the correction gain k increases monotonously with an increase in the arm operation amount, based on the cylinder velocity relative to the operation amount preliminarily obtained empirically or by simulation.

In S660, the third velocity calculation section 49*c* calculates a correction amount (k×cos φ) concerning the arm cylinder velocity Vamt3 by use of the correction gain k obtained in S620.

In S670, the third velocity calculation section 49*c* causes an estimated velocity (third velocity (Vamt3)) of the arm cylinder 6 to be a value obtained by adding the correction amount k×cos φ to the first velocity Vamt1 obtained by the first velocity calculation section 49*a*. In the case of passing through S620, since c is equal to or more than −90 degrees and equal to or less than 90 degrees, cos φ is equal to or more than 0, and the correction amount k×cos φ is also a value equal to or more than 0. In other words, the third velocity Vamt3 has a value equal to or more than the first velocity Vamt1.

As a result, the arm cylinder velocity calculation section 49 outputs the third velocity Vamt3 as the arm cylinder velocity Vam to the actuator control section 81, and the arm cylinder velocity calculation section 49 stands by until the next control period.

In the case where the determination in S610 is NO, the velocity selection section 49*d* determines in S630 whether or not the arm operation amount amlever is smaller than a predetermined threshold levert. Here, the threshold levert (see, for example, FIGS. 11 and 12) is an arm operation amount corresponding to a stroke amount SX at which a bleed-off opening of the arm spool closes (namely, the bleed-off opening area (center bypass opening area) becomes zero).

In the case where the determination in S630 is YES (namely, in the case where the bleed-off opening area is larger than zero), the velocity selection section 49*d* determines that the direction of a load exerted on the arm cylinder 6 by the weight of the object to be driven is opposite to the driving direction of the arm cylinder 6, and determines to output the second velocity (Vamt2) as the arm cylinder velocity Vam to the actuator control section 81, and the control proceeds to S640.

In S640, the second velocity calculation section 49*b* calculates a correction gain k concerning the arm cylinder velocity Vamt2 based on the arm operation amount amlever calculated by the operation amount calculation section 43*a*. Here, a function kmi for calculating the correction gain k by the second velocity calculation section 49*b* in S640 is made to be a function correlated with a meter-in opening area and a bleed-off opening area of an arm spool, considering that the influence of the weight of the object to be driven by the arm cylinder 6 is derived from the meter-in opening area and the bleed-off opening area of the arm spool related to the flow control valve 15*b*.

Figure 12:
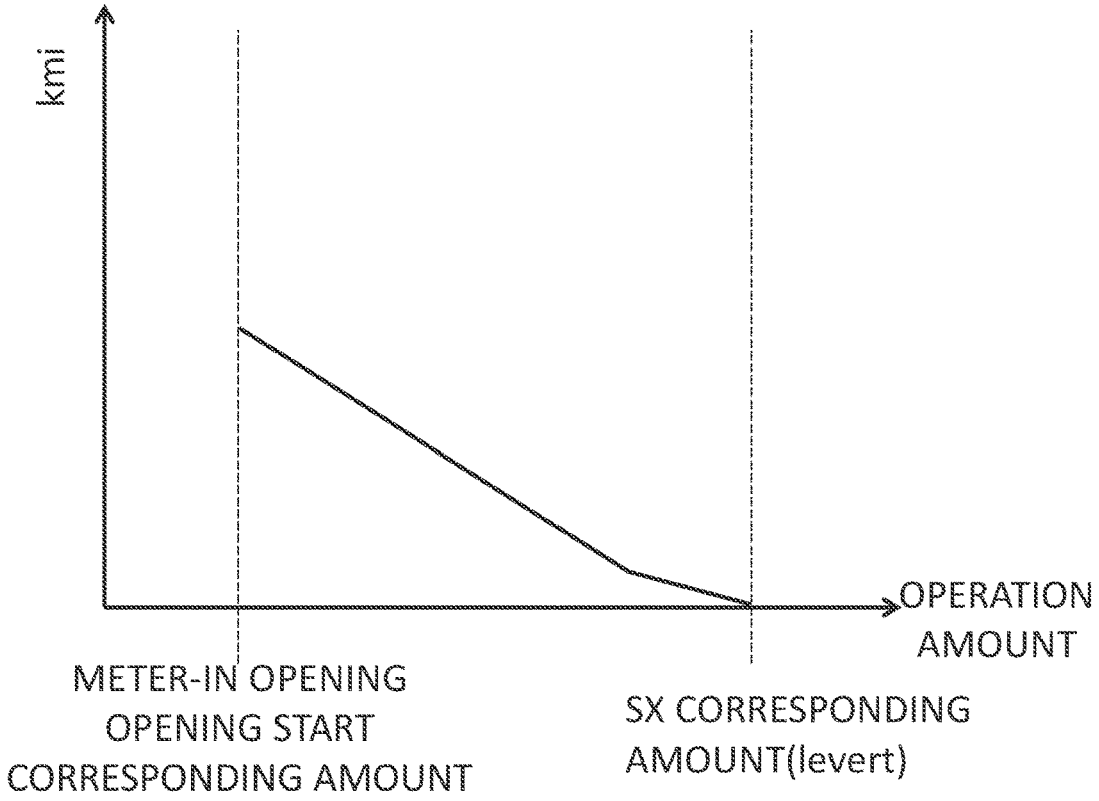
FIG. 12 is a diagram representing the relation between arm operation amount and a correction gain kmi.

In the present embodiment, it is presumed that the meter-out opening area and the bleed-off opening area of the arm spool are converted into an arm operation amount (amlever) corresponding thereto, and the second velocity calculation section 49*b* calculates the correction gain k based on the arm operation amount (amlever) calculated by the operation amount calculation section 43*a* and a table in FIG. 12 in which the correlation between arm operation amount (amlever) and the correction gain k (function kmi) is prescribed on a one-to-one basis. In the table in FIG. 12, the correlation between the operation amount and the correction gain k is prescribed in such a manner that the correction gain k decreases monotonously with an increase in the arm operation amount, based on the cylinder velocity relative to the operation amount preliminarily obtained empirically or by simulation.

In S680, the second velocity calculation section 49*b* calculates a correction amount (k×cos φ) concerning the arm cylinder velocity Vamt2 by use of the correction gain k obtained in S640.

In S690, the second velocity calculation section 49*b* causes an estimated velocity (second velocity (Vamt2)) of the arm cylinder 6 to be a value obtained by adding the correction amount k×cos φ to the first velocity Vamt1 obtained by the first velocity calculation section 49*a*. In the case of passing through S640, since c is less than −90 degrees or greater than 90 degrees, cos φ is a negative value, and the correction amount k×cos φ is also a negative value. In other words, the second velocity Vamt2 is a value smaller than the first velocity Vamt1.

As a result, the arm cylinder velocity calculation section 49 outputs the second velocity Vam2 as the arm cylinder velocity Vam to the actuator control section 81, and the arm cylinder velocity calculation section 49 stands by until the next control period.

In the case where the determination in S630 is NO (namely, in the case where the bleed-off opening area is zero), the hydraulic fluid supplied from the pump 2*b* to the flow control valve 15*b* entirely flows to the arm cylinder 6 since the bleed-off opening of the arm spool concerning the flow control valve 15*b* is in a closed state. In other words, the arm cylinder velocity in this instance is determined by the flow rate of the hydraulic fluid supplied, and, therefore, there is little influence of the weight of the object to be driven by the arm cylinder 6 on the arm cylinder velocity. In view of this, the velocity selection section 49*d* determines to output the first velocity (Vamt1) as the arm cylinder velocity Vam to the actuator control section 81, and the control proceeds to S650.

In S650, the first velocity calculation section 49*a* deems that there is substantially no influence of the weight of the object to be driven by the arm cylinder 6 on the arm cylinder velocity, and causes the correction gain k to be zero.

In S700, the first velocity calculation section 49*a* causes a velocity determined from the correlation in FIG. 9 and the arm operation amount (amlever) to be the first velocity Vamt1.

As a result, the arm cylinder velocity calculation section 49 outputs the first velocity Vamt1 as the arm cylinder velocity Vam to the actuator control section 81, and the arm cylinder velocity calculation section 49 stands by until the next control period.

<Flow of Boom Raising Control by Boom Control Section 81*a*>

Figure 13:
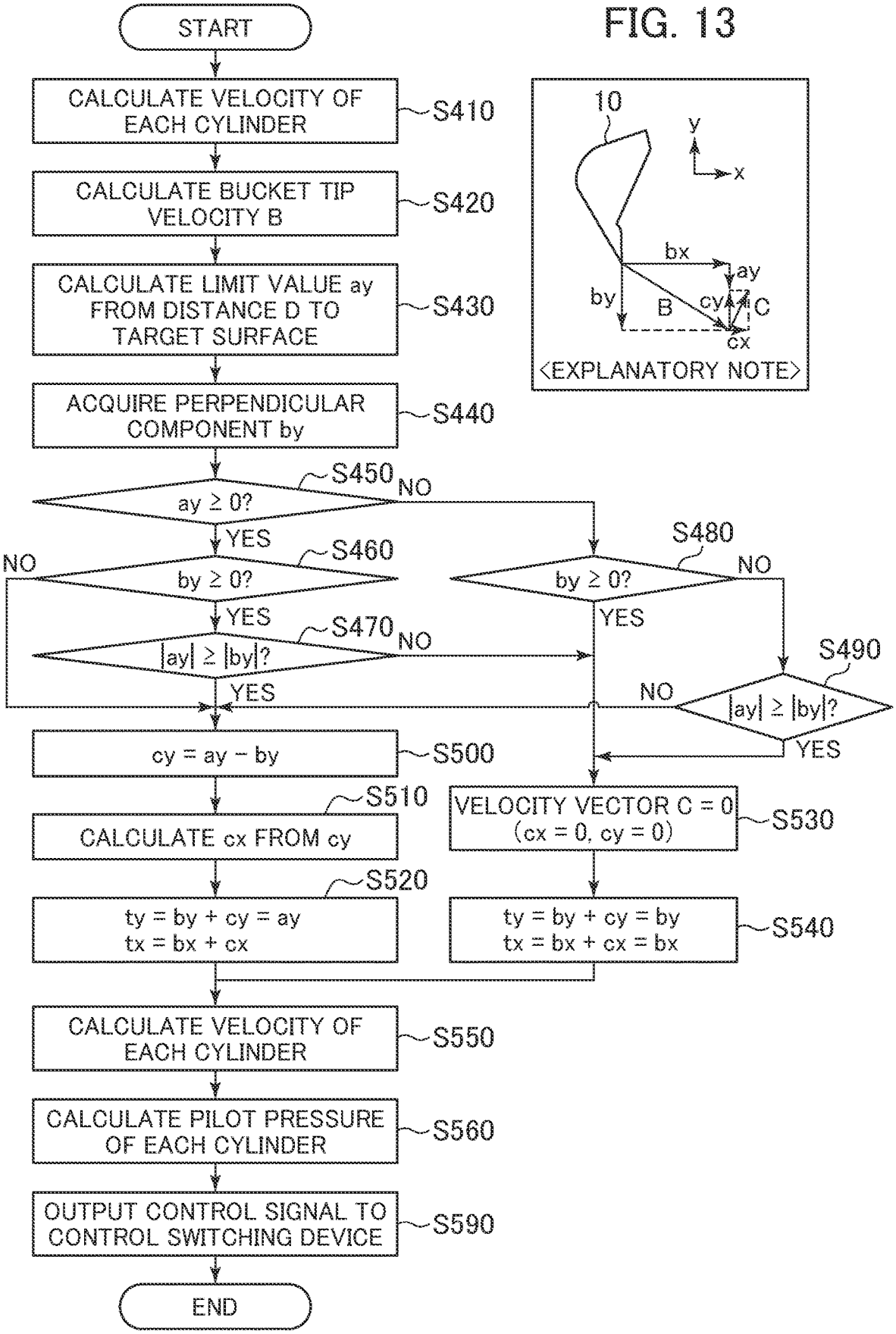
FIG. 13 is a flow chart for boom raising control by a boom control section.

The controller 40 in the present embodiment executes boom raising control by the boom control section 81*a* as MC. The flow of the boom raising control by the boom control section 81*a* is depicted in FIG. 13. FIG. 13 is a flow chart of the MC executed by the boom control section 81*a*, and the process is started when the operation devices 45*a*, 45*b* and 46*a* are operated by the operator.

In S410, the boom control section 81*a* acquires the velocities of the hydraulic cylinders 5, 6 and 7. First, as for the velocities of the boom cylinder 5 and the bucket cylinder 7, the velocities of the boom cylinder 5 and the bucket cylinder 7 are acquired by calculation based on the operation amounts of the boom 8 and the bucket 10 calculated by the operation amount calculation section 43*a*. Specifically, the cylinder velocities relative to the operation amount preliminarily obtained empirically or by simulation are set as a table similarly to FIG. 9 described above, and, according to the table, the velocities of the boom cylinder 5 and the bucket cylinder 7 are calculated. On the other hand, as for the velocity of the arm cylinder 6, a velocity Vam that the arm cylinder velocity calculation section 49 outputs based on the flow of FIG. 10 described above (namely, one of the first velocity Vamt1, the second velocity Vamt2 and the third velocity Vamt3) is acquired as the velocity of the arm cylinder 6.

In S420, the boom control section 81*a* calculates a velocity vector of the bucket tip (claw tip) by an operator's operation, based on operating velocities of the hydraulic cylinders 5, 6 and 7 acquired in S410 and the posture of the work device 1A calculated by the posture calculation section 43*b*.

Figure 14:
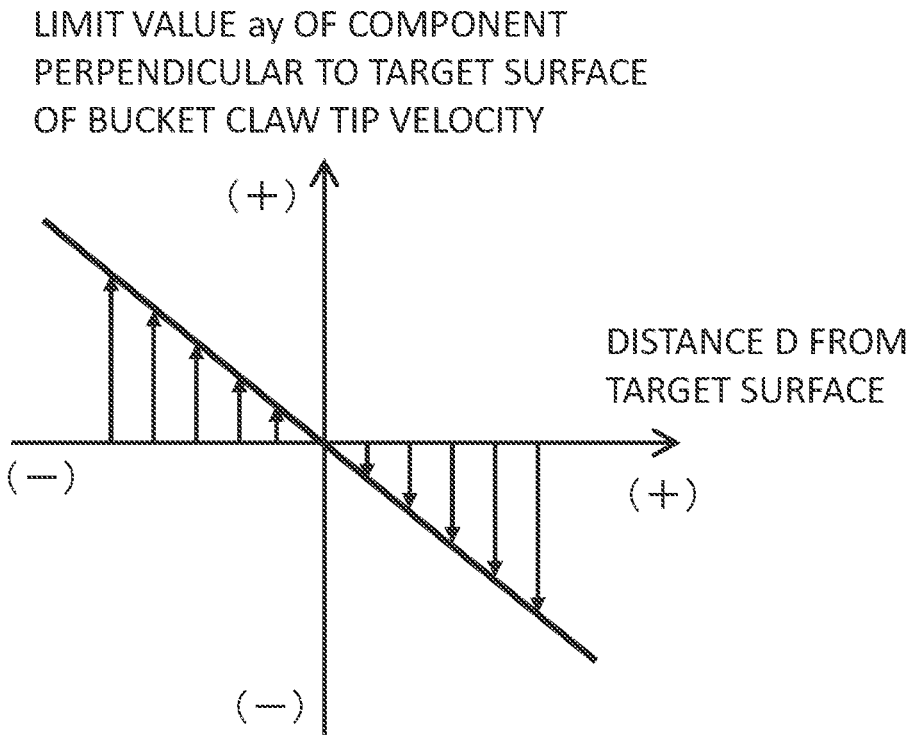
FIG. 14 is a diagram representing the relation between a limit value ay for a perpendicular component of bucket claw tip velocity and distance D.

In S430, the boom control section 81*a* calculates the distance D (see FIG. 5) from the bucket tip to the target surface 60 as an object to be controlled, from the position (coordinates) of the claw tip of the bucket 10 calculated by the posture calculation section 43*b* and the rectilinear distance including the target surface 60 stored in the ROM 93. Then, based on the distance D and the graph in FIG. 14, a limit value ay on a lower limit side of a component perpendicular to the target surface 60 of the velocity vector of the bucket tip is calculated.

In S440, the boom control section 81*a* acquires the component by perpendicular to the target surface 60, of the velocity vector B of the bucket tip by an operator's operation calculated in S420.

In S450, the boom control section 81*a* determines whether or not the limit value ay calculated in S430 is equal to or more than zero. Note that xy coordinates are set as depicted in the right upper part of FIG. 13. In the xy coordinates, an x axis is parallel to the target surface 60, and the rightward direction in the figure is positive, whereas a y axis is perpendicular to the target surface 60, and the upward direction in the figure is positive. In the explanatory note in FIG. 13, the vertical component by and the limit value ay are negative, whereas the horizontal component bx, the horizontal component cx and the vertical component cy are positive. As is clear from FIG. 14, a case where the limit value ay is zero is a case where the distance D is zero, namely, where the claw tip is located on the target surface 60, a case where the limit value ay is positive is a case where the distance D is negative, namely, where the claw tip is located below the target surface 60, and a case where the limit value ay is negative is a case where the distance D is positive, namely, where the claw tip is located on an upper side of the target surface 60. In the case where the limit value ay is determined to be equal to or more than zero in S450 (namely, in the case where the claw tip is located on or on a lower side of the target surface 60), the control proceeds to S460, and in the case where the limit value ay is less than zero, the control proceeds to S480.

In S460, the boom control section 81*a* determines whether or not the vertical component by of the velocity vector B of the claw tip by an operator's operation is equal to or more than zero. In the case where by is positive, it indicates that the vertical component by of the velocity vector B is upward, and in the case where by is negative, it indicates that the vertical component by of the velocity vector B is downward. In the case where the vertical component by is determined to be equal to or more than zero in S460 (namely, in the case where the vertical component by is upward), the control proceeds to S470, and in the case where the vertical component by is less than zero, the control proceeds to S500.

In S470, the boom control section 81*a* compares the absolute values of the limit value ay and the vertical component by, and, in the case where the absolute value of the limit value ay is equal to or more than the absolute value of the vertical component by, the control proceeds to S500. On the other hand, in the case where the absolute value of the limit value ay is less than the absolute value of the vertical component by, the control proceeds to S530.

In S500, the boom control section 81*a* selects "cy=ay−by" as a formula for calculating the component cy perpendicular to the target surface 60 of the velocity vector C of the bucket tip to be generated by an operation of the boom 8 by machine control, and calculate the vertical component cy based on the formula and the limit value ay in S430 and the vertical component by in S440. Then, a velocity vector C capable of outputting the calculated vertical component cy is calculated, and the horizontal component of the velocity vector C is made to be cx (S510).

In S520, a target velocity vector T is calculated.

Let the component perpendicular to the target surface 60 of the target velocity vector T be ty, and let the horizontal component be tx, then they can be expressed as "ty=by +cy, tx=bx+cx." When the formula (cy=ay−by) in S500 is put into these expressions, the target velocity vector T after all becomes "ty=ay, tx=bx+cx." In short, the vertical component ty of the target velocity vector in the case of reaching S520 is limited by the limit value ay, and forced boom raising by machine control is triggered.

In S480, the boom control section 81*a* determines whether or not the vertical component by of the velocity vector B of the claw tip by an operator's operation is equal to or more than zero. In the case where the vertical component by is determined to be equal to or more than zero in S480 (namely, in the case where the vertical component is upward), the control proceeds to S530, and in the case where the vertical component by is less than zero, the control proceeds to S490.

In S490, the boom control section 81*a* compares the absolute values of the limit value ay and the vertical component by, and, in the case where the absolute value of the limit value ay is equal to or more than the absolute value of the vertical component by, the control proceeds to S530. On the other hand, in the case where the absolute value of the limit value ay is less than the absolute value of the vertical component by, the control proceeds to S500.

In the case of reaching S530, it is unnecessary to operate the boom 8 by machine control, and, therefore, the boom control section 81*a* sets the velocity vector C to zero. In this case, based on the expressions utilized in S520 (ty=by +cy, tx=bx+cx), the target velocity vector T becomes "ty=by, tx=bx," which coincides with the velocity vector B by an operator's operation (S540).

In S550, the boom control section 81*a* calculates target velocities for the hydraulic cylinders 5, 6 and 7 based on the target velocity vector T (ty, tx) determined in S520 or S540. Note that as is clear from the above description, when the target velocity vector T does not coincide with the velocity vector B in the case of FIG. 13, the target velocity vector T is realized by adding the velocity vector C generated by the operation of the boom 8 by machine control to the velocity vector B.

In S560, the boom control section 81*a* calculates target pilot pressures for the flow control valves 15*a*, 15*b* and 15*c* of the hydraulic cylinders 5, 6 and 7 based on the target velocities for the cylinders 5, 6 and 7 calculated in S550.

In S590, the boom control section 81*a* outputs the target pilot pressures for the flow control valves 15*a*, 15*b* and 15*c* of the hydraulic cylinders 5, 6 and 7 to the solenoid proportional valve control section 44.

The solenoid proportional valve control section 44 controls the solenoid proportional valves 54, 55 and 56 in such a manner that the target pilot pressures act on the flow control valves 15*a*, 15*b* and 15*c* of the hydraulic cylinders 5, 6 and 7, whereby excavation by the work device 1A is performed. For example, in the case where the operator operates the operation device 45*b* to perform horizontal excavation by an arm crowding operation, the solenoid proportional valve 55*c* is controlled in such a manner that the tip of the bucket 10 does not penetrate into the target surface 60, and a raising operation of the boom 8 is automatically performed.

Note that in the present embodiment, boom control (forced boom raising control) by the boom control section 81*a* and bucket control (bucket angle control) by the bucket control section 81*b* are performed as MC; however, boom control according to the distance D between the bucket 10 and the target surface 60 may be performed as MC.

Operation and Effects

In the hydraulic excavator configured as above-mentioned, an operator's operation in the case of transition from a state S1 (arm horizontal angle $\varphi 1 \leq 90$ degrees) to a state S2 (arm horizontal angle $\varphi 2 > 90$ degrees) in FIG. 15 and MC by the controller 40 (boom control section 81*a*) will be described.

Figure 15:
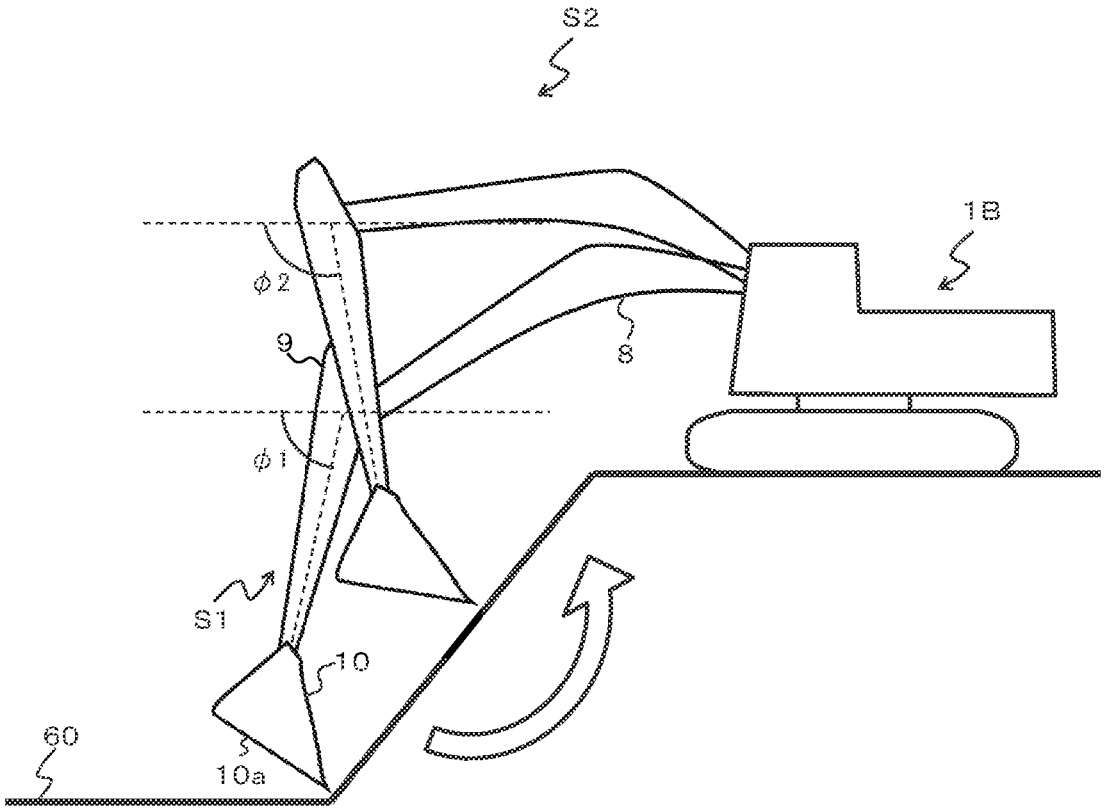
FIG. 15 is an explanatory diagram of a cutting-up work.

In transition from the state S1 to the state S2 in FIG. 15, the operator performs a crowding operation of the arm 9. When it is judged that the bucket 10 penetrates into the target surface 10 due to the crowding operation of the arm 9, a command is outputted from the boom control section 81*a* to the solenoid valve 54*a*, and a control (MC) for raising the boom 8 is performed.

When MC is performed at an arm horizontal angle $\varphi$ of equal to or less than 90 degrees as in the state S1, the weight of the front work device (the arm 9 and the bucket 10) on the front side of the arm 9 acts in the direction for accelerating the arm cylinder velocity, and, therefore, the actual arm cylinder velocity tends to be higher than the value (first velocity Vamt1) estimated from the arm operation amount (amlever) in that instance. In the present embodiment, however, the control flow of FIG. 10 ensures that in the case where the arm horizontal angle $\varphi$ is equal to or less than 90 degrees, the third velocity Vamt3 higher than the first velocity Vamt1 is outputted as an arm cylinder velocity Vam to the actuator control section 81. As a result, the difference between the arm cylinder velocity Vam (=Vamt3) inputted to the actuator control section 81 and utilized for MC and the actual arm cylinder velocity is smaller than that in the conventional method in which the first velocity Vamt1 is always utilized as the arm cylinder velocity for MC irrespectively of the magnitude of the arm horizontal angle $\varphi$. Consequently, the boom raising operation amount by the MC can be calculated more properly, the MC is stabilized, and the working accuracy of the target surface 60 is enhanced. Particularly, in the present embodiment, the correction amount (namely, the difference $k \times \cos \varphi$ between the first velocity Vamt1 and the third velocity Vamt3) is varied according to variations in the arm horizontal angle $\varphi$ (see FIG. 10) and the arm operation amount (see FIG. 11), and, therefore, MC stability and working accuracy can be further enhanced.

Next, when MC is carried out at an operator's arm operation amount (amlever) of less than a threshold levert in a state in which the arm horizontal angle $\varphi$ exceeds 90 degrees as in the state S2, the weight of the front work device (the arm 9 and the bucket 10) on the front side of the arm 9 acts in the direction for decelerating the arm cylinder velocity, and, therefore, the actual arm cylinder velocity tends to be lower than the value (first velocity Vamt1) estimated from the arm operation amount (amlever) in that instance. In the present embodiment, however, the control flow of FIG. 10 ensures that the second velocity Vamt2 lower than the first velocity Vamt1 is outputted as an arm cylinder velocity Vam to the actuator control section 81. As a result, the difference between the arm cylinder velocity Vam (Vamt2) inputted to the actuator control section 81 and utilized for MC and the actual arm cylinder velocity is smaller than that in the conventional method in which the first velocity Vamt1 is always utilized as the arm cylinder velocity for MC irrespectively of the magnitude of the arm horizontal angle $\varphi$. Consequently, the boom raising operation amount by the MC can be calculated more properly, and, therefore, the MC is stabilized, and the working accuracy of the target surface 60 is enhanced. Particularly, in the present embodiment, the correction amount (namely, the difference $k \times \cos \varphi$ between the first velocity Vamt1 and the second velocity Vamt2) is varied according to variations in the arm horizontal angle $\varphi$ (see FIG. 10) and the arm operation amount (see FIG. 12), and, therefore, MC stability and working accuracy can be further enhanced.

Next, when MC is performed at an operator's arm operation amount (amlever) of equal to or more than the threshold levert in a state in which the arm horizontal angle $\varphi$ exceeds 90 degrees as in the state S2, the bleed-off opening of the arm spool concerning the flow control valve 15*b* is in a closed state, and the hydraulic fluid supplied to the flow control valve 15*b* entirely flows to the arm cylinder 6. Therefore, there is substantially no influence of the weight of the front work device (the arm 9 and the bucket 10) on the front side of the arm 9 on the arm cylinder velocity, and the arm cylinder velocity (first velocity Vamt1) estimated from the arm operation amount (amlever) is outputted to the actuator control section 81 to perform the MC, like in the conventional method. Consequently, in the case where the bleed-off opening is closed, MC stability and working accuracy like those in the conventional method can be maintained.

In the present embodiment, therefore, taking into account the influence of the weight of the front work device (the arm 9 and the bucket 10) on the front side of the arm 9 as above-mentioned, an appropriate correction amount is added to the arm cylinder velocity (first velocity Vamt1) estimated from the arm operation amount (amlever), whereby the difference from the actual arm cylinder velocity is reduced. Consequently, it becomes possible to calculate an appropriate boom raising operation amount (namely, target velocities of the hydraulic cylinders 5, 6 and 7), and it is possible to stabilize the behavior of the bucket tip in MC.

<Others>

In the above-described embodiment, when the arm horizontal angle $\gamma$ exceeds 90 degrees and the arm operation amount is equal to or more than the threshold levert, a control of not correcting the arm cylinder velocity is performed. However, a system may be configured such that in this case, also, the second velocity is outputted to the actuator control section 81. In other words, a system may be configured in which the control proceeds to S640 in the case where the determination in S610 in FIG. 10 is NO.

While a system has been configured in FIG. 10 in which the control proceeds to S630 in the case where the determination in S610 is NO, a system may be configured in which the determining process in S630 is conducted before S610.

While angle sensors for sensing the angles of the boom 8, the arm 9 and the bucket 10 have been used in the above-described embodiment, the posture information concerning the excavator may be calculated not by the angle sensors but by cylinder stroke sensors. In addition, while description has been made taking a hydraulic pilot type excavator as an example, in the case of an electric lever type excavator a configuration may be adopted in which a command current generated from an electric lever is controlled. As for a calculating method for the velocity vector of the front work device 1A, the velocity vector may be obtained not from the pilot pressures by operator's operations but from angular velocities calculated by differentiating the angles of the boom 8, the arm 9 and the bucket 10.

Part or the whole of the configurations concerning the above-mentioned controller 40, the functions and carrying-out processes of the configurations and the like may be realized by hardware (for example, designing the logics for carrying out the functions by integrated circuit). In addition, the configurations concerning the controller 40 may be a program (software) which, by being executed, realizes the functions concerning the configurations of the controller 40. Information concerning the program can be stored, for example, in semiconductor memory (flash memory, SSD, and the like), magnetic storage device (hard disk drive, and the like), recording medium (magnetic disk, optical disk, and the like) and so on.

The present invention is not limited to the above-described embodiment, but includes various modifications in such ranges as not to depart from the gist of the invention. For example, the present invention is not limited to one that includes all the configurations described in the embodiment above, but includes those in which part of the configurations is omitted. Besides, part of the configuration concerning the embodiment may be replaced by other configuration, or other configuration may be added.

DESCRIPTION OF REFERENCE CHARACTERS

1A: Front work device
8: Boom
9: Arm
10: Bucket
30: Boom angle sensor
31: Arm angle sensor
32: Bucket angle sensor
40: Controller (controller)
43: MC control section
43*a*: Operation amount calculation section
43*b*: Posture calculation section
43*c*: Target surface calculation section
49: Arm cylinder velocity calculation section
49*a*: First velocity calculation section
49*b*: Second velocity calculation section
49*c*: Third velocity calculation section
49*d*: Velocity selection section
44: Solenoid proportional valve control section
45: Operation device (boom, arm)
46: Operation device (bucket, swing)
50: Work device posture sensor (posture sensor)
51: Target surface setting device
52*a*: Operator operation amount sensor (operation amount sensor)
53: Display device
54, 55, 56: Solenoid proportional valve
81: Actuator control section
81*a*: Boom control section
81*b*: Bucket control section

The invention claimed is:

1. A work machine comprising:

a work device that has a plurality of front members including an arm;

a plurality of hydraulic actuators that include an arm cylinder driving the arm and that drive the plurality of front members;

an operation device that gives instruction on operations of the plurality of hydraulic actuators according to an operation of an operator;

a controller having an actuator control section that controls at least one of the plurality of hydraulic actuators according to velocities of the plurality of hydraulic actuators and a predetermined condition when the operation device is operated;

a posture sensor that senses a physical quantity concerning a posture of the arm; and an operation amount sensor that senses a physical quantity concerning an operation amount for the arm of operation amounts of the operation device, wherein the controller includes:

a first velocity calculation section that calculates a first velocity calculated from a sensed value from the operation amount sensor as a velocity of the arm cylinder;

a second velocity calculation section that, based on a sensed value from the posture sensor, determines a direction of a load applied to the arm cylinder by the weight of the arm, and, upon determining that the direction of the load is opposite to a driving direction of the arm cylinder, calculates as the velocity of the arm cylinder a second velocity lower than the first velocity as a velocity of the arm cylinder; and a third velocity calculation section that, upon determining that the direction of the load is same as the driving direction of the arm cylinder, calculates as the velocity of the arm cylinder a third velocity equal to or higher than the first velocity as a velocity of the arm cylinder.

2. The work machine according to claim 1, wherein the second velocity calculation section calculates the second velocity taking an influence of the weight of the arm into account, and the third velocity calculation section calculates the third velocity taking an influence of the weight of the arm into account.

3. The work machine according to claim 1, wherein each of a first correction amount that is a deviation between the first velocity and the second velocity, and a second correction amount that is a deviation between the first velocity and the third velocity varies according to variations in a sensed value from the posture sensor and a sensed value from the operation amount sensor.

4. The work machine according to claim 1, comprising a velocity selection section that outputs one of the first velocity calculated by the first velocity calculation section, the second velocity calculated by the second velocity calculation section, and the third velocity calculated by the third velocity calculation section to the actuator control section, wherein the velocity selection section:

outputs, when a sensed value from the operation amount sensor is equal to or more than a predetermined value, the first velocity to the actuator control section as a velocity of the arm cylinder;

outputs, upon determining that the sensed value from the operation amount sensor is less than the predetermined value and the direction of the load is opposite to the driving direction of the arm cylinder, the second velocity to the actuator control section as a velocity of the arm cylinder; and outputs, upon determining that the sensed value from the operation amount sensor is less than the predetermined value and the direction of the load is the same as the driving direction of the arm cylinder, the third velocity to the actuator control section as a velocity of the arm cylinder.

* * * * *